US010105719B2

(12) United States Patent
Matsuura

(10) Patent No.: US 10,105,719 B2
(45) Date of Patent: Oct. 23, 2018

(54) ELECTROSTATIC ATOMIZER, MIST GENERATION METHOD

(71) Applicant: NanoMist Technologies Co., Ltd., Tokushima (JP)

(72) Inventor: Kazuo Matsuura, Tokushima (JP)

(73) Assignee: NANOMIST TECHNOLOGIES CO., LTD., Tokushima (JP)

( * ) Notice: Subject to any disclaimer, the term of this patent is extended or adjusted under 35 U.S.C. 154(b) by 505 days.

(21) Appl. No.: 14/370,443

(22) PCT Filed: Dec. 27, 2012

(86) PCT No.: PCT/JP2012/083930

§ 371 (c)(1),
(2) Date: Jul. 2, 2014

(87) PCT Pub. No.: WO2013/103126

PCT Pub. Date: Jul. 11, 2013

(65) Prior Publication Data

US 2015/0129672 A1 May 14, 2015

(30) Foreign Application Priority Data

Jan. 5, 2012 (JP) ..... 2012-000844

(51) Int. Cl.
*B05B 5/08* (2006.01)
*B05B 5/057* (2006.01)
(Continued)

(52) U.S. Cl.
CPC ..... *B05B 5/087* (2013.01); *B05B 5/03* (2013.01); *B05B 5/0403* (2013.01); *B05B 5/057* (2013.01);
(Continued)

(58) Field of Classification Search
CPC ..... B05B 5/04; B05B 5/0403; B05B 5/0407; B05B 5/0533; B05B 5/08; B05B 5/087;
(Continued)

(56) References Cited

U.S. PATENT DOCUMENTS 3,406,660 A * 10/1968 Simm ..... B05B 5/08 118/300
4,613,076 A * 9/1986 Dietz ..... B05B 5/04 239/3
(Continued)

FOREIGN PATENT DOCUMENTS

JP 2011-14776 * 1/2011 ..... H01L 21/368
JP 2011-014776 A 1/2011
JP 2011014776 * 1/2011 ..... H01L 21/368

OTHER PUBLICATIONS

International Search Report of PCT/JP2012/083930, dated Mar. 26, 2013.

*Primary Examiner* — Alexander Valvis
*Assistant Examiner* — Christopher R Dandridge
(74) *Attorney, Agent, or Firm* — Plumsea Law Group, LLC

(57) ABSTRACT

Provided is an electrostatic atomizing device which performs atomization at low cost. An electrostatic atomizing device (M4) is installed in an atomization chamber (10) of a separation apparatus. The electrostatic atomizing device (M4) includes a plate-like inclined surface electrode (101) and a plate-like counter electrode (102) parallel to the surface electrode (101). A solution is diffused by diffusers (108) onto an upper end of the surface electrode (101). The solution flows down along a front surface of the surface electrode (101) while being spread in a thin film form, and is atomized by an electric field between the surface electrode (101) and the counter electrode (102).

26 Claims, 17 Drawing Sheets

(51) Int. Cl.

| | |
|---|---|
| ***B05B 5/03*** | (2006.01) |
| ***B05B 5/16*** | (2006.01) |
| ***B05B 5/04*** | (2006.01) |
| ***B05B 5/053*** | (2006.01) |

(52) U.S. Cl.
CPC ..... *B05B 5/0533* (2013.01); *B05B 5/16* (2013.01); *B05B 5/1608* (2013.01)

(58) Field of Classification Search
CPC ..... B05B 5/16; B05B 5/1608; B05B 5/057; B05B 5/03; B05B 5/0535; B05B 5/00
USPC ..... 239/690–708
See application file for complete search history.

(56) References Cited

U.S. PATENT DOCUMENTS

| | | | | |
|---|---|---|---|---|
| 4,830,872 | A * | 5/1989 | Grenfell | B05B 5/0255 118/626 |
| 2010/0006027 | A1 * | 1/2010 | Yang | B05B 5/082 118/671 |

* cited by examiner

ELECTROSTATIC ATOMIZER, MIST GENERATION METHOD

This application is a national stage application of International Patent Application No. PCT/JP2012/083930, filed Dec. 27, 2012 (WO 2013/103126 A1, published Jul. 11, 2013), which claims priority to Japanese Patent Application No. 2012-000844, filed Jan. 5, 2012, both of which are herein incorporated by reference in reference in their entirety.

TECHNICAL FIELD

The present invention relates to a technology for electrostatic atomization.

BACKGROUND ART

As atomization technologies, there have been known spraying, an ultrasonic atomization technology, an electrostatic atomization technology, and the like. Among others, the electrostatic atomization technology has an advantage of low running cost.

An electrostatic atomizing device used in the conventional electrostatic atomization technology is configured as follows.

The conventional electrostatic atomizing device includes a hollow and fine needle electrode (capillary) having a lower end immersed in a solution to be atomized, and a counter electrode for generating an appropriate electric field between the counter electrode and the needle electrode, the counter electrode having, for example, a ring shape. The solution siphoned up through the needle electrode due to a capillary phenomenon is finely divided by the electric field between the needle electrode and the counter electrode so that the solution is atomized. In this way, fine particles of the solution (mist) are generated.

SUMMARY OF THE INVENTION

Problems to be Solved by the Invention

The conventional electrostatic atomizing device described above has a given function, and is practically used in a humidifier, a separation apparatus for separating a solute and a solvent in a solution from each other, and the like.

However, the conventional electrostatic atomizing device has still left some room for improvement. Such room becomes much more conspicuous, for example, in a case where more fine particles of the solution need to be generated, more specifically, in a case where the electrostatic atomizing device is applied to the separation apparatus.

As described above, the conventional electrostatic atomizing device generates mist by using the hollow needle electrode. Thus, in order to generate the fine particles of the solution by a given amount or more per unit time, more needle electrodes need to be provided. Although such a technique has already been put to practical use, when such a technique is employed, a manufacturing cost and a maintenance cost of the electrostatic atomizing device tend to excessively increase.

It is an object of the present invention to improve an electrostatic atomization technology so as to generate more fine particles of a solution per unit time while suppressing increases in the above-mentioned costs.

Means to Solve the Problems

In order to achieve the above-mentioned object, the inventor of the present invention proposes the following invention.

The present invention is roughly divided into the following two exemplary embodiments.

According to a first exemplary embodiment of the present invention, there is provided an electrostatic atomizing device, including: a surface electrode having a two-dimensionally expanded front surface; and a counter electrode for generating a predetermined electric field between the counter electrode and the surface electrode. In the electrostatic atomizing device, the predetermined electric field is generated between the surface electrode and the counter electrode under a state in which the front surface of the surface electrode is coated with a solution to be atomized in a thin film form, to thereby generate fine particles of the solution from a plurality of points of a surface of the solution, which is coated onto the surface electrode.

As described above, the conventional electrostatic atomizing device includes the hollow needle electrode, and such an electrostatic atomizing device has been commonly used. However, the inventor of the present invention has conducted studies and confirmed that, also in a case where the surface electrode having the two-dimensionally expanded front surface is used instead of the hollow needle electrode, when the two-dimensionally expanded front surface of the surface electrode is coated with the solution in a thin film form and the appropriate electric field is generated between the surface electrode and the counter electrode, fine particles are generated from the solution in a thin film form.

In addition, such an electrostatic atomizing device can be easily manufactured in comparison with the conventional electrostatic atomizing device in which a large number of hollow needle electrodes need to be provided. Thus, even when many fine particles need to be generated from the solution, the manufacturing cost can be easily suppressed, and the maintenance cost can be easily suppressed as well because the number of small components can be reduced.

Further, this electrostatic atomizing device is designed to generate more fine particles of the solution per unit electric power or unit area.

As described above, the surface electrode according to the first exemplary embodiment of the present invention has the two-dimensionally expanded front surface. Meanwhile, the counter electrode may be formed into an appropriate shape such as a linear shape, a bar shape, and a planar shape including a plate shape. The same applies to a second exemplary embodiment of the present invention.

For example, the counter electrode may also have the two-dimensionally expanded front surface. When the counter electrode has the two-dimensionally expanded front surface, the fine particles of the solution can be stably and easily generated from a wide range on the front surface of the surface electrode. In this case, the two-dimensionally expanded front surface of the counter electrode may face the two-dimensionally expanded front surface of the surface electrode at least within a range in which the fine particles of the solution are to be generated. With this, in the range on the front surface of the surface electrode, in which the fine particles of the solution are to be generated, an electric potential gradient similar to that on the counter electrode can be easily generated. Thus, the fine particles of the solution can be easily generated as intended. Note that, in the case where the counter electrode has the two-dimensionally expanded front surface, the front surface of the counter electrode may be parallel to the front surface of the surface electrode (when the front surface of the surface electrode is a curved surface, the front surface of the counter electrode is also a curved surface in conformity therewith). Also with this, the electric potential gradient of the counter electrode and the electric potential gradient of the surface electrode can be equalized to each other over a wide range on the front surface of the surface electrode (for example, the entire range, or a range on the front surface of the surface electrode, in which the fine particles of the solution are to be generated).

As described above, the surface electrode of the first exemplary embodiment of the present invention has the two-dimensionally expanded front surface. The front surface may include a smooth surface, a surface with protrusions and recesses, holes, or grooves, or a surface having a mesh shape as long as the entire front surface is two-dimensionally expanded. Further, the two-dimensionally expanded front surface may include a flat surface, a curved surface, a plurality of flat surfaces, a plurality of curved surfaces, or a combination of the flat surface and the curved surface. The same applies to the second exemplary embodiment.

Further, the surface electrode may be made of a metal (for example, conductive metal), which applies to the second exemplary embodiment. Further, in the first exemplary embodiment, the surface electrode may be formed of one of woven fabric and nonwoven fabric. Note that, the woven fabric includes knitted fabric (knit).

As long as the surface electrode has a shape other than the mesh shape or is made of a material other than the woven fabric and the nonwoven fabric, as described above, the smooth surface may be employed as the front surface of the surface electrode. However, in that case, the smooth front surface of the surface electrode may be provided with a large number of protrusions each having a height of 1 mm or less. With this, the solution is efficiently atomized into fine particles at parts corresponding to the large number of protrusions, at which the electric potential gradient on the front surface of the surface electrode is specifically higher than those at parts therearound. The large number of protrusions can be formed, for example, by fixing particles (for example, metal particles) each having a diameter of 1 mm or less to the front surface of the surface electrode.

On the front surface of the surface electrode, there may be formed one of a layer made of a hydrophobic material and a layer made of a hydrophilic material. With this, when the solution contains a solute and a solvent, a ratio of the solute and the solvent of fine particles to be generated from the solution is more easily changed. The same applies to the second exemplary embodiment.

Examples of the hydrophobic material and the hydrophilic material may include aluminum oxide, ceramics, and resins such as a fluorine resin.

Further, the layer formed of the hydrophobic material and the layer formed of the hydrophilic material each need to be thin to an extent that the surface electrode and the counter electrode are not insulated from each other.

Next, supplementary description is made of cases where the change of the ratio of the solute and the solvent of the fine particles to be generated from the solution is effective.

The atomization technology can be used as a separation technology, specifically, a technology for separating a solute and a solvent in a solution from each other. This conclusion is based on the following findings obtained through studies of the inventor of the present invention. When a solution, which is a solvent containing a solute, is atomized by an appropriate technique such as spraying, ultrasonic atomization, and electrostatic atomization, a large number of fine particles of the solution are generated through the atomization. The fine particles of the solution vary in size, and there is a correlationship between sizes of the fine particles and a concentration of the solution contained in each of the fine particles (ratio of the solute and the solvent). Thus, when the fine particles generated through atomization of the solute are classified based on their sizes, the solute and the solvent in the solution can be separated from each other.

When the electrostatic atomizing device of the present invention is applied to such a separation technology using atomization, it is preferred that the correlationship between the sizes of the fine particles of the solution and the concentration of the solution be closer. When the one of the layer formed of the hydrophobic material and the layer formed of the hydrophilic material is formed on the front surface of the surface electrode, the closer correlationship may be established.

As a cause of a further change of the ratio of the solute and the solvent in the fine particles of the solution, the following can be conceived. For example, when a hydrophobic liquid is supplied on a surface of a hydrophobic substance, in general, a contact angle therebetween is lower than that in a case where the hydrophobic liquid is supplied on a surface of a hydrophilic substance. When a ratio of a solute and a solvent of a part of a solution spread in a thin film form on a front surface (for example, front surface of the surface electrode) is set such that a wettability of the solution with respect to the front surface is small (such that rounder droplets are easily formed), the solution is more easily atomized into fine particles at that part than at other parts. In other words, in a case where the solute and the solvent contained in the solution are different from each other in wettability and the ratio of the solute and the solvent in the solution is slightly biased, when the front surface of the surface electrode is hydrophobic or hydrophilic, the fine particles of the solution can be generated under a state in which the bias of the ratio of the solute and the solvent in the solution coated, in a thin film form, onto the front surface of the surface electrode is emphasized.

In the first exemplary embodiment, as described above, the solution to be atomized is coated, in a thin film form, onto the front surface of the surface electrode. How to coat the front surface of the surface electrode with the solution may be appropriately selected.

The solution, which is coated, in a thin film form, onto the front surface of the surface electrode, gradually decreases both in amount and thickness along with atomization. Thus, in addition to the initially supplied solution, an additional solution needs to be supplied to the front surface of the surface electrode. The additional solution may be continuously supplied or supplied in batches. However, in order to obtain fine particles of a large amount of solution at low cost, it is desired that the solution be continuously supplied while keeping balance with the design of the electrostatic atomizing device.

In the following, description is made of some measures to coat the front surface of the surface electrode with the solution in a thin film form, including another method for supplying the solution to the front surface of the surface electrode.

In the case where the surface electrode has a mesh shape, the solution may be supplied from a back surface side of the surface electrode having the mesh shape onto the front surface of the surface electrode through spaces in the surface electrode having the mesh shape. In this case, the solution supplied onto the front surface of the surface electrode is spread in the thin film form and is coated onto the front surface of the surface electrode. For example, the mesh-like surface electrode is horizontally arranged near a liquid surface of a pool of the solution, and a liquid level of the pool of the solution is kept so that the solution in a thin film form has a thickness within a given range, in other words, the solution in a thin film form is kept slightly higher than the front surface of the surface electrode.

In this case, the counter electrode may have a front surface facing, for example, the entire surface of the surface electrode, the front surface of the counter electrode may parallel to the front surface of the surface electrode.

In the case where the surface electrode is formed of one of the woven fabric and the nonwoven fabric, the solution may be supplied from a back surface side of the surface electrode formed of the one of the woven fabric and the nonwoven fabric onto the front surface of the surface electrode through gaps among fibers of the surface electrode formed of the one of the woven fabric and the nonwoven fabric. In this case, the solution supplied onto the front surface of the surface electrode is spread in the thin film form and is coated onto the front surface of the surface electrode. For example, the surface electrode is horizontally arranged near the liquid surface of the pool of the solution, and the liquid level of the pool of the solution is kept at a level that the back surface of the surface electrode is brought into contact with the solution. With this, the front surface of the woven fabric and the nonwoven fabric gets wet. Even by such slight wetting, the solution can be spread in a thin film form on the front surface of the surface electrode.

In this case, the counter electrode may have a front surface facing, for example, the entire surface of the surface electrode, the front surface of the counter electrode may parallel to the front surface of the surface electrode.

The front surface of the surface electrode may be horizontal and provided with a large number of holes through which the solution is supplied onto the front surface of the surface electrode. Further, the solution may be spread in the thin film form and may be coated onto the front surface of the surface electrode by being supplied through the holes.

For example, as in the case of the mesh-like surface electrode, the surface electrode provided with the large number of holes is horizontally arranged near the liquid surface of the pool of the solution, and the liquid level of the pool of the solution is kept slightly higher than the horizontal front surface of the surface electrode. Alternatively, pipes for supplying the solution may be connected respectively to the large number of holes so that the solution, which is coated, in a thin film form, onto the horizontal front surface of the surface electrode, has a thickness within a given range.

In this case, the counter electrode may have a front surface facing, for example, the entire front surface of the surface electrode, the front surface of the counter electrode may parallel to the front surface of the surface electrode.

The surface electrode may be formed into a cylindrical shape, and the front surface of the surface electrode may be an outer peripheral surface of the surface electrode having the cylindrical shape. Further, the surface electrode may be rotated about a horizontal axis of the cylindrical shape, and the outer peripheral surface on a lower side of the surface electrode may be immersed in the solution. In this case, the solution adhering to the front surface of the surface electrode is spread in the thin film form and is coated onto the front surface of the surface electrode along with rotation of the surface electrode.

In this case, the counter electrode may have a front surface facing, for example, at least a part of the outer peripheral surface of the surface electrode, which is not immersed in the solution, a curved surface of the counter electrode may parallel to the outer peripheral surface of the surface electrode.

The surface electrode may be formed into a cylindrical shape, and the front surface of the surface electrode may be an inner peripheral surface of the surface electrode having the cylindrical shape. Further, the surface electrode may be rotated about a horizontal axis of the cylindrical shape, and the inner peripheral surface on a lower side of the surface electrode may be immersed in the solution. In this case, the solution adhering to the front surface of the surface electrode is spread in the thin film form and is coated onto the front surface of the surface electrode along with rotation of the surface electrode.

In this case, the counter electrode may include a bar-like electrode or a linear electrode arranged at a part corresponding to the axis. Alternatively, the counter electrode may have a front surface facing, for example, at least a part of a cylindrical member, which is coaxial with the axis and corresponds to a part of the inner peripheral surface of the surface electrode, which is not immersed in the solution, a curved surface of the counter electrode may parallel to the inner peripheral surface of the surface electrode.

The electrostatic atomizing device may further include: means for supplying the solution onto the front surface of the surface electrode; and means for blowing a gas onto the front surface of the surface electrode. The solution supplied on the front surface of the surface electrode may advance in the thin film form in a blowing direction of the gas and may be coated onto the front surface of the surface electrode.

With this, the front surface of the surface electrode can be easily coated with the solution in a thin film form. In this case, the front surface of the surface electrode may be horizontal.

In this case, the counter electrode may have a front surface facing, for example, the entire front surface of the surface electrode, the front surface of the counter electrode may parallel to the front surface of the surface electrode.

Further, the electrostatic atomizing device may further include means for supplying the solution onto the front surface of the surface electrode. The front surface of the surface electrode may be inclined, and the solution supplied on the front surface of the surface electrode may drip by gravity, advance in the thin film form, and be coated onto the t front surface of the surface electrode.

With this, the front surface of the surface electrode can be easily coated with the solution in a thin film form. In addition, it is unnecessary to apply energy for advancing the solution.

In this case, the counter electrode may have a front surface facing, for example, the entire front surface of the surface electrode, a front surface parallel to the front surface of the surface electrode.

The surface electrode may be formed into a horizontal disk-like shape, the front surface of the surface electrode may be an upper surface of the surface electrode having the horizontal disk-like shape, the surface electrode may be rotated about an axis perpendicular to the horizontal disk-like shape, and the electrostatic atomizing device may further include means for supplying the solution, which is provided near the axis of rotation on the upper surface of the surface electrode. The solution supplied near the axis of rotation on the front surface of the surface electrode may advance in the thin film form by a centrifugal force generated by rotation of the surface electrode, and may be coated onto the front surface of the surface electrode.

With this, the front surface of the surface electrode can be easily coated with the solution in a thin film form. In this case, the front surface of the surface electrode may be horizontal.

In this case, the counter electrode may have a front surface facing, for example, a given range (ring-shaped range), for example, on an outer side of the front surface of the surface electrode, the front surface of the counter electrode may parallel to the front surface of the surface electrode. The thickness of the solution in a thin film form can be easily kept constant at a part closer to an outer periphery of the front surface of the surface electrode. Thus, in order to generate the fine particles of the solution mainly from that part, it is preferred to use such a counter electrode.

The surface electrode may be formed into a shape of a rotator, the rotator being obtained by rotating, about a Y-axis in a coordinate system, a segment in a first quadrant, which is one of a straight line, a curve, and a combination of the straight line and the curve, the segment having a slope of zero or less at each coordinate point between an X-axis and the Y-axis and having both ends respectively intersecting with the X-axis and the Y-axis, the rotator being convex upward with the Y-axis serving as a perpendicular rotational axis. Further, the front surface of the surface electrode may be an outer peripheral surface of the surface electrode having the shape of the rotator. Further, the surface electrode may be rotated about the perpendicular rotational axis of the shape of the rotator. The electrostatic atomizing device may further include means for supplying the solution, which is provided near the perpendicular rotational axis on the front surface of the surface electrode. The solution supplied near the perpendicular rotational axis on the front surface of the surface electrode may advance in the thin film form by a centrifugal force generated by rotation of the surface electrode, and may be coated onto the front surface of the surface electrode.

With this, the front surface of the surface electrode can be easily coated with the solution in a thin film form. In this case, although the outer peripheral surface of the surface electrode may include a horizontal part, the solution advances on the outer peripheral surface of the surface electrode convex upward regardless of whether or not the part has a downward inclination toward the outside.

In this case, the counter electrode may have a front surface facing, for example, the entire range on the front surface of the surface electrode, the front surface of the counter electrode may parallel to the front surface of the surface electrode.

In each of the four examples, an advancing direction of the solution in a thin film form is predetermined. In those cases, when the front surface of the surface electrode is a smooth surface, the front surface of the surface electrode may be provided with a groove having a depth of 1 mm or less in a direction along the advancing direction in which the solution advances in a thin film form. When such a groove is formed, advancement of the solution which advances in the thin film form can be promoted.

In the first exemplary embodiment, the solution in the thin film form may have a thickness of, for example, from 0.1 mm to 2.0 mm. When the thickness of the solution in the thin film form is kept within this range, the fine particles of the solution can be efficiently obtained.

The same advantages as those of the electrostatic atomizing device of the first exemplary embodiment can be obtained also by the following method of generating mist.

For example, the advantages can be obtained by a method of generating mist using an electrostatic atomizing device including: a surface electrode having a two-dimensionally expanded front surface; and a counter electrode for generating a predetermined electric field between the counter electrode and the surface electrode, the method including generating the predetermined electric field between the surface electrode and the counter electrode under a state in which the front surface of the surface electrode is coated with a solution in a thin film form, to thereby generate fine particles of the solution from a plurality of points of a surface of the solution, which is coated onto the surface electrode.

In the first exemplary embodiment, the solution may have a viscosity of from approximately 0.01 cP to 100 cP. Within such a viscosity range, the fine particles of the solution can be easily obtained. The same applies to the second exemplary embodiment.

The second exemplary embodiment is configured as follows.

According to the second exemplary embodiment, there is provided an electrostatic atomizing device, including: a surface electrode having a two-dimensionally expanded front surface, the surface electrode being formed into a plate-like shape and provided with a large number of holes; and a counter electrode for generating a predetermined electric field between the counter electrode and the surface electrode. In the electrostatic atomizing device, the predetermined electric field is generated between the surface electrode and the counter electrode under a state in which droplets of a solution to be atomized, each having a diameter of from 0.001 mm to 1 mm, are supplied near the front surface of the surface electrode from a back surface side of the surface electrode through the large number of holes, to thereby generate, from the droplets, fine particles of the solution, which are smaller than the droplets.

Through the studies, the inventor of the present invention has confirmed that, also in the case where droplets of the solution are supplied near the two-dimensionally expanded front surface of the surface electrode, instead of use of the hollow needle electrode, so that an appropriate electric field is generated between the surface electrode and the counter electrode, the droplets are finely divided and the fine particles of the solution are generated therefrom.

In addition, such an electrostatic atomizing device can be easily manufactured in comparison with the conventional electrostatic atomizing devices in which a large number of hollow needle electrodes need to be provided. Thus, even when many fine particles need to be generated from the solution, the manufacturing cost can be easily suppressed, and the maintenance cost can be easily suppressed as well because the number of small components can be reduced.

Note that, the droplets in the second exemplary embodiment may include solid droplets and hollow droplets (bubbles). For example, the solid droplets can be obtained through spraying, and the hollow droplets can be obtained with air diffusing devices arranged in the solution. As a matter of course, such droplets may be obtained by other appropriate means.

In the second exemplary embodiment, the surface electrode may have a mesh shape. In the second exemplary embodiment, the surface electrode may be made of a metal.

The same counter electrode as that described in the first exemplary embodiment can be used also in the second exemplary embodiment.

In each of the first exemplary embodiment and the second exemplary embodiment, a potential difference between the surface electrode and the counter electrode can be set to range from, for example, approximately 3 kV to 50 kV.

As described above, also in the second exemplary embodiment, the one of the layer formed of the hydrophobic material and the layer formed of the hydrophilic material may be formed on the front surface of the surface electrode. When the one of the layer formed of the hydrophobic material and the layer formed of the hydrophilic material is formed on the front surface of the surface electrode, at least an inside of each of the holes in a part corresponding to the layer is formed of corresponding one of the hydrophobic material and the hydrophilic material. In the second exemplary embodiment, the droplets of the solution to be atomized, each having the diameter of from 0.001 mm to 1 mm, are supplied near the front surface of the surface electrode from the back surface side of the surface electrode through the holes provided through the surface electrode, and the droplets are further finely divided by the electric field generated between the surface electrode and the counter electrode. In this way, the fine particles of the solution are generated from the droplets. When at least a part of the inside of each of the holes is formed of corresponding one of the hydrophobic material and the hydrophilic material, the droplets, which pass through the holes, can be passed somewhat selectively in accordance with wettabilities of the droplets. With this, the fine particles generated from the solution can contain a larger amount of desired one of the solvent and the solute, which can be achieved by setting the diameter of each of the holes to be somewhat smaller, specifically, by setting the diameter of each of the holes to be ten times to one hundred times as large as the diameter of each of the droplets.

The same advantages as those of the electrostatic atomizing device of the second exemplary embodiment can be obtained also by the following method of generating mist.

For example, the advantages can be obtained by a method of generating mist using an electrostatic atomizing device including: a surface electrode having a two-dimensionally expanded front surface, the surface electrode being formed into a plate-like shape and provided with a large number of holes; and a counter electrode for generating a predetermined electric field between the counter electrode and the surface electrode, the method including generating the predetermined electric field between the surface electrode and the counter electrode under a state in which droplets of a solution to be atomized, each having a diameter of from 0.001 mm to 1 mm, are supplied near the front surface of the surface electrode from a back surface side of the surface electrode through the large number of holes, to thereby generate, from the droplets, fine particles of the solution, which are smaller than the droplets.

MODE FOR CARRYING OUT THE INVENTION

In the following, description is made of preferred embodiments of the present invention.

The same components in description of each of the embodiments are denoted by the same reference symbols, and redundant description thereof is omitted as appropriate.

Note that, as a matter of course, an electrostatic atomizing device, which is used in a separation apparatus in each of first to third embodiments of the present invention, can be used for other various applications.

(First Embodiment)

The separation apparatus according to the first embodiment is used for separating a solution, which is a solvent containing a solute, into the solute and the solvent. Detailed description of the solution is made below.

Figure 1:
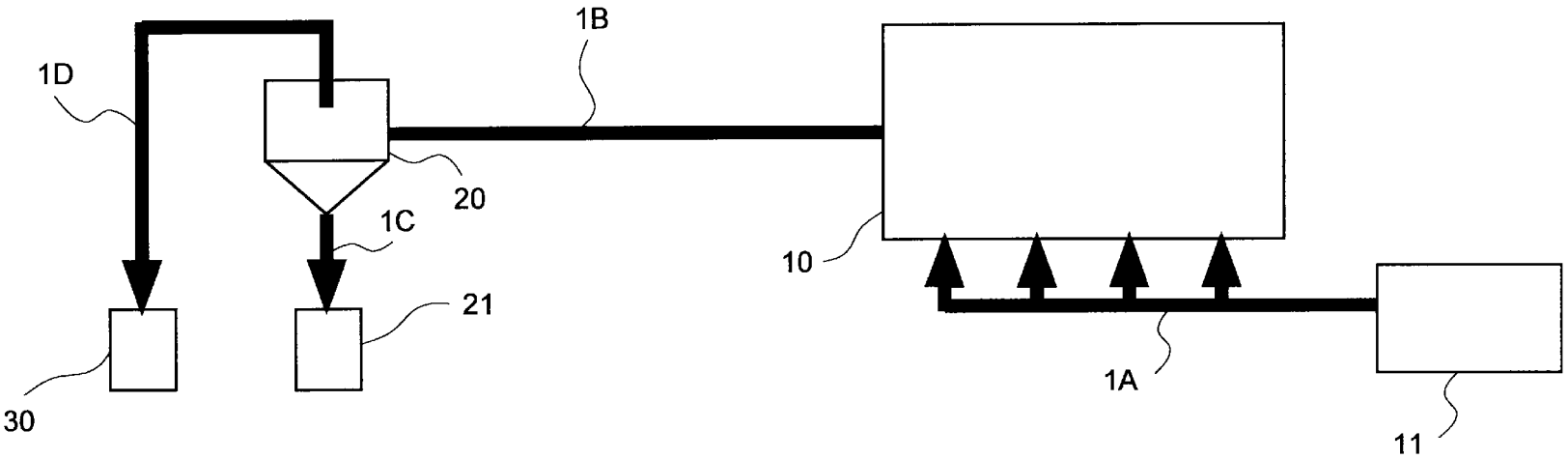
FIG. 1 is a schematic side view of an overall structure of a separation apparatus according to a first embodiment of the present invention.

FIG. 1 schematically illustrates an overall structure of the separation apparatus according to the first embodiment of the present invention.

As illustrated in FIG. 1, the separation apparatus according to the first embodiment of the present invention includes an atomization chamber 10, a storage tank 11, a classifier 20, a first collection tank 21, and a second collection tank 30.

The atomization chamber 10 and the storage tank 11, the atomization chamber 10 and the classifier 20, the classifier 20 and the first collection tank 21, and the classifier 20 and the second collection tank 30 are respectively connected to each other with connecting pipes 1A, 1B, 1C, and 1D each formed of a general pipe made, for example, of a metal and having, for example, a circular shape in cross-section.

The atomization chamber 10 is a chamber for atomizing the solution into fine particles, and houses an electrostatic atomizing device for atomizing the solution into fine particles. Although description of a structure of the electrostatic atomizing device housed in the atomization chamber 10 is made below, the electrostatic atomizing device may include a single electrostatic atomizing device or a plurality of electrostatic atomizing devices. Although the atomization chamber 10 in this embodiment is made of a metal and hermetically sealed, the atomization chamber 10 may be made of other materials and need not be hermetically sealed.

In the atomization chamber 10, in addition to the fine particles of the solution, a gas of the solution is generated through evaporation of the solution. As a result, even when air does not exist in the atomization chamber 10 at first, the gas containing the fine particles is generated in the atomization chamber 10.

The storage tank 11 is a tank for storing the solution, and supplies as appropriate the solution into the atomization chamber 10 through the connecting pipes 1A. Although not shown, pumps and the like necessary for the supply of the solution are provided as appropriate.

The gas containing the fine particles is sent from the atomization chamber 10 to the classifier 20 through the connecting pipe 1B.

The classifier 20 is configured to classify the fine particles contained in the gas sent from the atomization chamber 10. The classifier 20 in this embodiment classifies the fine particles contained in the gas sent from the atomization chamber 10 depending on the size so that particles larger than a predetermined reference size are collected.

The classifier 20 of any type may be employed as long as the fine particles can be classified. For example, there may be employed various known classifiers such as a classifier which utilizes a cyclone, a mesh demister, a corrugated plate. Although detailed description is omitted, the classifier 20 in this embodiment is the classifier which utilizes a cyclone.

The classifier 20 also includes the first collection tank 21 capable of storing liquid. After the fine particles are classified depending on the size by the classifier 20, the particles larger than a given reference size are sent to the first collection tank 21 through the connecting pipe 1C. Then, the larger particles are liquefied by know techniques, and pooled in the first collection tank 21. The liquid thus collected in the first collection tank 21 is referred to as first solution.

Meanwhile, other fine particles and a gas containing the other fine particles, which are not captured by the classifier 20 or sent to the first collection tank 21 (in other words, fine particles and a gas containing those fine particles, which pass through the classifier 20), are sent to the second collection tank 30 through the connecting pipe 1D. The fine particles are liquefied by known methods in the second collection tank 30, and pooled in the second collection tank 30. The liquid thus collected in the second collection tank 30 is referred to as second liquid.

As described above, the solution is evaporated in the atomization chamber 10, and hence an air pressure in the atomization chamber 10 is relatively higher than that in the second collection tank 30. Therefore, in the entire separation apparatus, a gas flow from the atomization chamber 10 to the second collection tank 30 is generated, and the fine particles are moved together with the gas flow. As a matter of course, when the gas flow is insufficient, it is apparent to those skilled in the art to implement the following design as appropriate: increasing the air pressure in the atomization chamber 10, for example, through the supply of air; reducing the air pressure in the second collection tank 30; and providing a blower for promoting the gas flow between the atomization chamber 10 and the second collection tank 30.

Next, description is made of the structure of the electrostatic atomizing device provided in the atomization chamber 10.

As described below, some electrostatic atomizing devices are exemplified in this embodiment. Those electrostatic atomizing devices described in this embodiment each include a surface electrode having a two-dimensionally expanded front surface and a counter electrode for generating a predetermined electric field between the counter electrode and the surface electrode.

In each of the electrostatic atomizing devices, the electric field is generated between the surface electrode and the counter electrode under a state in which a front surface of the surface electrode is coated with a solution to be atomized in a thin film form. In this way, the fine particles of the solution are generated from a plurality of points of a surface of the solution coating the surface electrode.

Those electrostatic atomizing devices are different from each other mainly in mechanism for coating the surface electrode with the solution in a thin film form.

In the following, description is made of the electrostatic atomizing devices of specific examples.

Note that, the electrostatic atomizing device provided in the atomization chamber 10 may include any of the following electrostatic atomizing devices, and the following electrostatic atomizing devices may be electrostatic atomizing devices of the same type or different types, and each may include a plurality of electrostatic atomizing devices of the same type or different types.

EXAMPLE 1 OF ELECTROSTATIC ATOMIZING DEVICE

Figure 2:
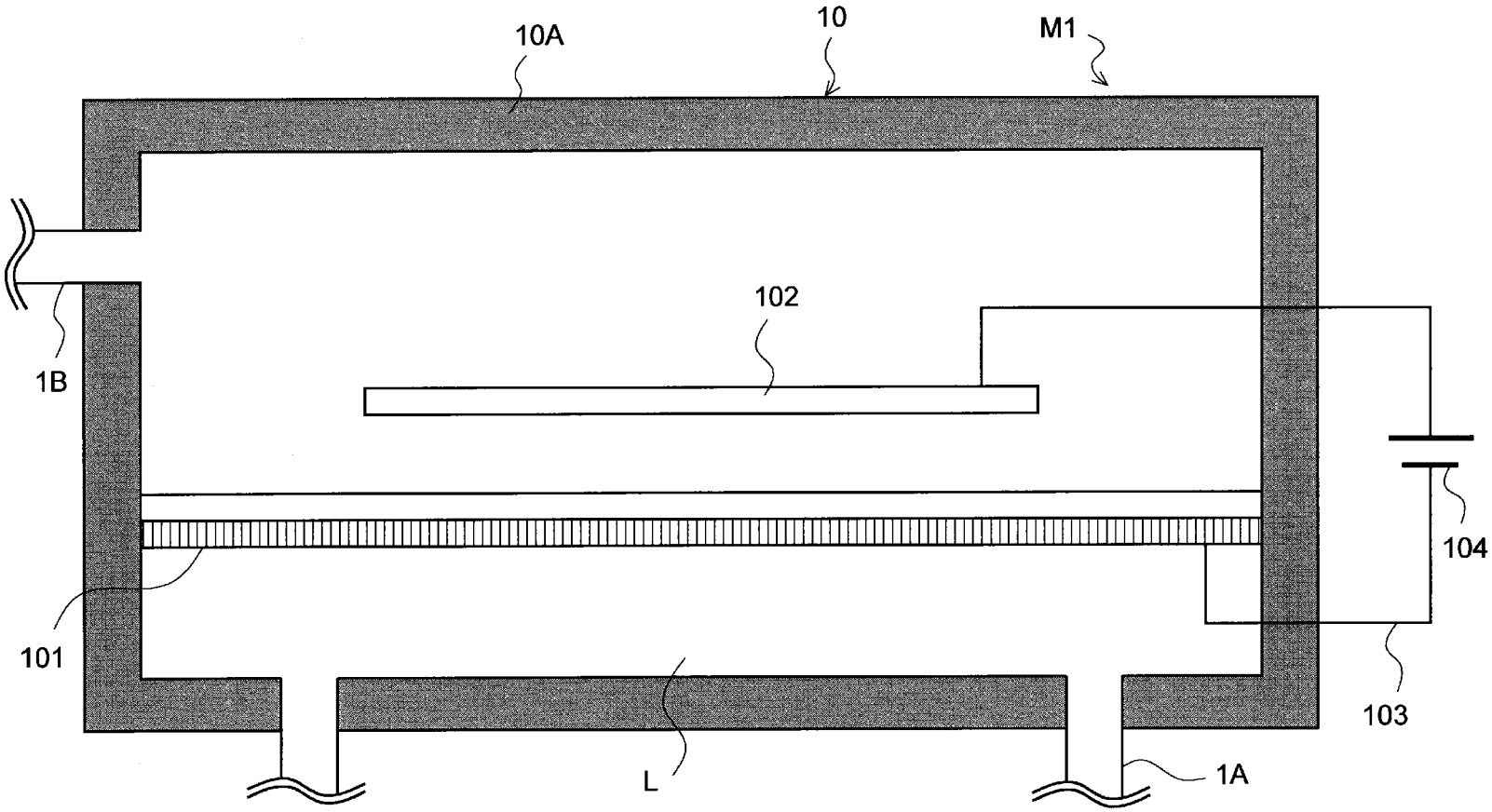
FIG. 2 is a side view of a structure of an electrostatic atomizing device of Example 1, which is used in the separation apparatus illustrated in FIG. 1.

FIG. 2 illustrates an electrostatic atomizing device M1 of Example 1, which is formed of the entire atomization chamber 10.

In FIG. 2, walls 10A surround the atomization chamber 10. In this embodiment, the walls 10A of the atomization chamber 10 form therein a space having a rectangular parallelepiped shape.

The connecting pipes 1A are connected to one surface of the walls 10A, which corresponds to a floor part of the atomization chamber 10, and the connecting pipe 1B is connected to another surface of the walls 10A, which is perpendicular to the floor part, so that the storage tank 11 and the classifier 20 communicate to the inside of the atomization chamber 10.

In the inside of the atomization chamber 10, there is provided a surface electrode 101 having a rectangular plate-like shape. The surface electrode 101 is horizontally arranged. In this example, four sides of the surface electrode 101 are each fixed with an appropriate fitting (not shown) to respective four surfaces of the walls 10A, which are perpendicular to the four sides. When a rigidity of the surface electrode 101 is insufficient to maintain the horizontal shape, the surface electrode 101 can be supported at other appropriate positions.

The surface electrode 101 in this example has a mesh shape. More specifically, the surface electrode 101 in this example is a fine mesh produced by welding, to each other, metal wires extending in a matrix pattern and each having a given diameter. The diameter of the wires forming the fine mesh, a size of spaces of the fine mesh, and the like can be appropriately determined. The surface electrode 101 may further include a grating as well as the mesh shape.

The surface electrode 101 in this example is made of a conductive metal such as iron and copper. However, as in a case described below, when the solution is seawater and the like, the surface electrode 101 is liable to corrode. In order to avoid the corrosion, it is appropriate to form the surface electrode 101 with a corrosion-resistant metal such as stainless steel. Those raw materials can be employed when surface electrodes 101 for the electrostatic atomizing devices of other examples are also made of a metal.

Further, at least a front surface of the surface electrode 101 may be coated with a hydrophobic layer or a hydrophilic layer (the front surface of the surface electrode 101 refers to a surface facing the counter electrode described below, which corresponds to an upper surface of the surface electrode 101 in this example). In the electrostatic atomizing device M1 of Example 1, all the surfaces of the surface electrode 101 are coated with the hydrophobic layer or the hydrophilic layer. Materials for the hydrophobic layer and the hydrophilic layer include, for example, aluminum oxide, ceramics, and resins such as a fluorine resin. For example, the entire surface electrode 101 formed of a fine mesh is easily coated with the fluorine resin, the aluminum oxide. Note that, at least the front surface of the surface electrode 101 may be coated with the hydrophobic layer or the hydrophilic layer also in the electrostatic atomizing devices of other examples as long as the surface electrode 101 is made of a material other than woven fabric and nonwoven fabric.

The atomization chamber 10 is provided with a counter electrode 102. The counter electrode 102 is an electrode for generating a predetermined electric field between the counter electrode 102 and the surface electrode 101. In order that the electric field can be generated, the surface electrode 101 and the counter electrode 102 are connected to each other through intermediation of conductive wires 103 connected to an electric power source 104 therebetween. A degree of a potential difference between the surface electrode 101 and the counter electrode 102 is not particularly limited as long as the solution can be atomized with the electric field to be formed between the surface electrode 101 and the counter electrode 102 with the electric power source 104 as described below. In that case, the potential difference between the surface electrode 101 and the counter electrode 102 can be set to range from, for example, approximately 3 kV to 50 kV, and a clearance between the surface electrode 101 and the counter electrode 102 can be set to range from 1 cm to 30 cm. With this, an electrostatic field is generated between the surface electrode 101 and the counter electrode 102. The electrostatic field between the surface electrode 101 and the counter electrode 102 may be directed in any direction. In other words, a potential of any one of the surface electrode 101 and the counter electrode 102 may be higher than that of the other. The relationships of the potential difference and the electric field between the surface electrode 101 and the counter electrode 102 are applied also to the electrostatic atomizing devices described below. In other words, the surface electrode 101 and the counter electrode 102 are configured so that fine particles of the solution in a thin film form are generated by the electric field near the front surface of the surface electrode 101 under a state in which the solution exists in the electric field near the front surface of the surface electrode 101.

The counter electrode 102 may be formed into an appropriate shape such as a linear shape and a bar shape. In this example, the counter electrode 102 is formed into a plate-like shape, and in addition, although not necessarily, is horizontal. A front surface of the counter electrode 102 is parallel to the surface electrode 101 (the front surface of the counter electrode 102 refers to a surface facing the surface electrode 101, which corresponds to a lower surface of the counter electrode 102 in this example). Although the counter electrode 102 in this example is formed into a rectangular shape and one size smaller than the surface electrode 101, other shapes and sizes may be employed.

A solution L is supplied from the storage tank 11 into the atomization chamber 10 through the connecting pipes 1A, and the solution L supplied from the storage tank 11 is evaporated to generate a gas. Meanwhile, a liquid surface of the solution L is adjusted to be kept slightly higher than the front surface of the surface electrode 101 (in FIG. 2, for ease of understanding, the liquid surface of the solution L is rather higher than the upper surface of the surface electrode 101). This adjustment is performed, for example, as follows: monitoring the position of the liquid surface with an appropriate sensor for detecting the position of the liquid surface; and additionally supplying the solution L from the storage tank 11 when the surface electrode 101 is exposed as the liquid surface becomes lower. As described above, a distance between the liquid surface of the solution L and the front surface of the surface electrode 101, in other words, a thickness of the solution L in a thin film form, which is illustrated on an exaggerated scale in FIG. 2, is positioned actually, for example, approximately 0.1 mm to 2.0 mm above the upper surface of the surface electrode 101. In still other words, the front surface of the surface electrode 101 in this example is coated with the solution L in a thin film form, which has a thickness of from approximately 0.1 mm to 2.0 mm. Note that, the thickness of the solution L in a thin film form, which is coated onto the front surface of the surface electrode 101, is kept within the range of from approximately 0.1 mm to 2.0 mm also in the electrostatic atomizing devices described below.

As described above, the electric field is generated between the surface electrode 101 and the counter electrode 102. Basically, forces in the same directions as those of imaginary electric flux lines corresponding to the electric field act on the solution L in a thin film form on the surface electrode 101 (note that, except the parts corresponding to the spaces). With this, when a viscosity of the solution L is, for example, 100 cP or less, the solution L is atomized into fine particles. In this way, the fine particles of the solution L are generated. Note that, this condition of the viscosity of the solution L is applied also to the other electrostatic atomizing devices described below. In this example, the fine particles of the solution L are generated from the entire front surface except the parts corresponding to the spaces of the surface electrode 101.

The fine particles and the gas of the solution L are sent to the classifier 20 through the connecting pipe 1B.

EXAMPLE 2 OF ELECTROSTATIC ATOMIZING DEVICE

An electrostatic atomizing device of Example 2 has substantially the same structure as that of the electrostatic atomizing device M1 of Example 1.

The electrostatic atomizing device of Example 2 is different therefrom only in the surface electrode 101.

The surface electrode 101 of the electrostatic atomizing device of Example 2 has a rectangular shape of the same size as that of the surface electrode 101 of the electrostatic atomizing device M1 of Example 1. Similarly to the surface electrode 101 of the electrostatic atomizing device M1 of Example 1, four sides thereof are fixed to the walls 10A. Further, at least the front surface, specifically, the upper surface of the surface electrode 101 is a horizontal smooth surface. The front surface of the surface electrode 101 may be coated with a hydrophobic layer or a hydrophilic layer. This is because, when a surface to be coated is horizontal and smooth, the hydrophobic layer or the hydrophilic layer is easily formed with processed ceramics. Note that, although it is not necessary to coat the entire front surface of the surface electrode 101 with the hydrophobic layer or the hydrophilic layer, for example, a part to generate the fine particles of the solution L in a thin film form (for example, part of the front surface of the surface electrode 101 facing the front surface of the counter electrode 102) may be coated with the hydrophobic layer or the hydrophilic layer.

Figure 3A:
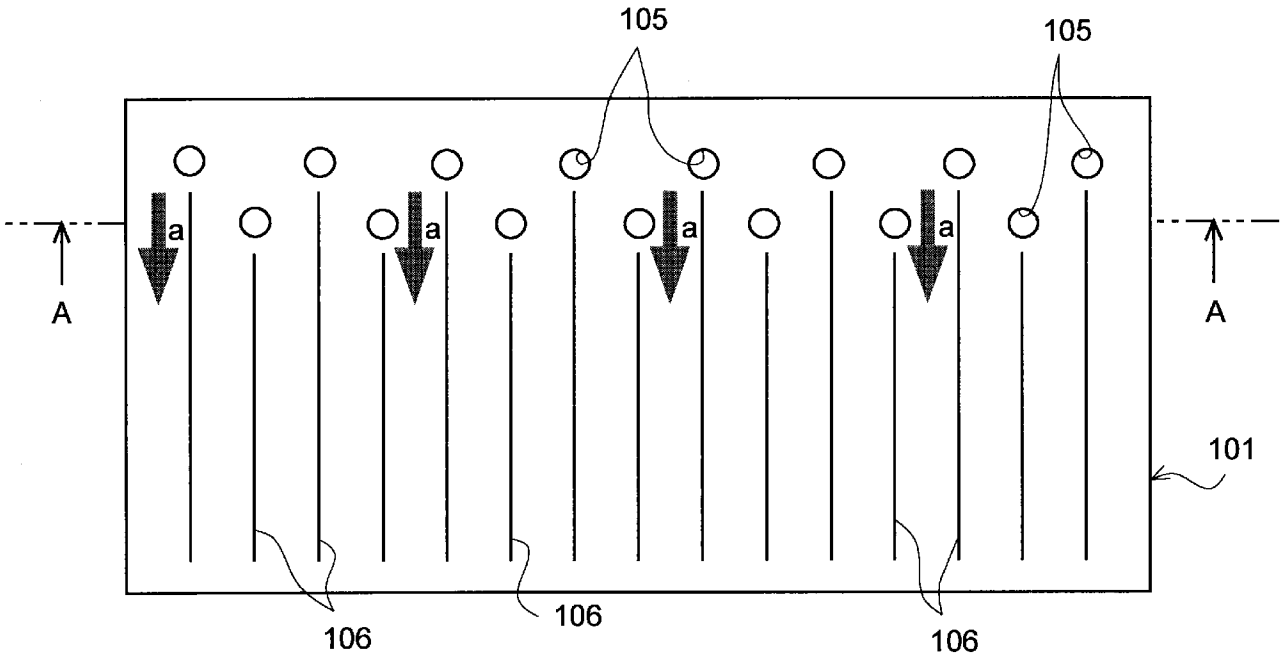
FIG. 3A is a plan view and FIG. 3B is a side view of a structure of a surface electrode of an electrostatic atomizing device of Example 2, which is used in the separation apparatus illustrated in FIG. 1.
Figure 3B:
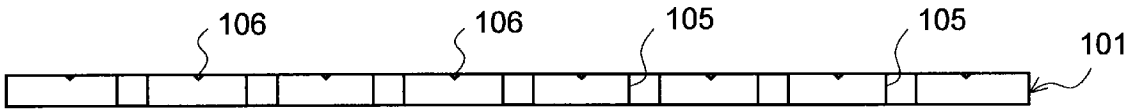

The surface electrode 101 of the electrostatic atomizing device of Example 2 includes a metal plate, and has a structure as illustrated in FIG. 3A as a plan view and FIG. 3B as a sectional view taken along the line A-A in FIG. 3A. Although this surface electrode 101 has a rectangular shape and is provided with a plurality of holes 105 formed through a vicinity of one longitudinal side thereof, other shapes may be employed and the holes 105 need not be provided. Although the holes 105 in this example each have a circular shape, other shapes may be employed.

The holes 105 are provided so that the solution L slightly overflows onto the front surface, specifically, the upper surface of the surface electrode 101. The holes 105 are provided over the entire front surface of the surface electrode 101, and the solution L may overflow in a thin film form so as to coat the entire front surface of the surface electrode 101. In this example, a blower (not shown) blows wind in a direction "a" onto the front surface of the surface electrode 101 so that the solution L, which overflows through the holes 105, is moved in the direction "a" in a thin film form, and is coated onto substantially the entire front surface of the surface electrode 101.

Further, in this example, in the front surface of the surface electrode 101, grooves 106 are formed respectively from vicinities of the holes 105 along a direction parallel to a short side of the surface electrode 101, in other words, along the direction in which the solution L in a thin film form is moved by the blower. Note that, the grooves 106 may be provided at larger intervals or smaller intervals, and each have a depth of, for example, 1 mm or less. The grooves 106 facilitate a spread of the solution L into a thin film form and movement of the solution L thus spread into the thin film form on the surface electrode 101.

The solution L spread in a thin film form on the surface electrode 101 is atomized into particles in the electric field as in the electrostatic atomizing device M1 of Example 1.

Note that, although not shown, on the front surface of the surface electrode 101, there may be provided, for example, a large number of protrusions by fusing, for example, metal particles each having a diameter of 1 mm or less. With this, atomization of the solution L into particles can be promoted.

The fine particles and the gas of the solution L are sent to the classifier 20 through the connecting pipe 1B.

As long as the surface electrode 101 is made of a material other than woven fabric and nonwoven fabric, the following configurations described above are applicable also to the electrostatic atomizing devices described below: forming the front surface of the surface electrode 101 into a smooth surface; providing protrusions on the smooth front surface of the surface electrode 101; and providing the grooves 106 along a predetermined direction in which the solution L is moved on the front surface of the surface electrode 101.

EXAMPLE 3 OF ELECTROSTATIC ATOMIZING DEVICE

Figure 4:
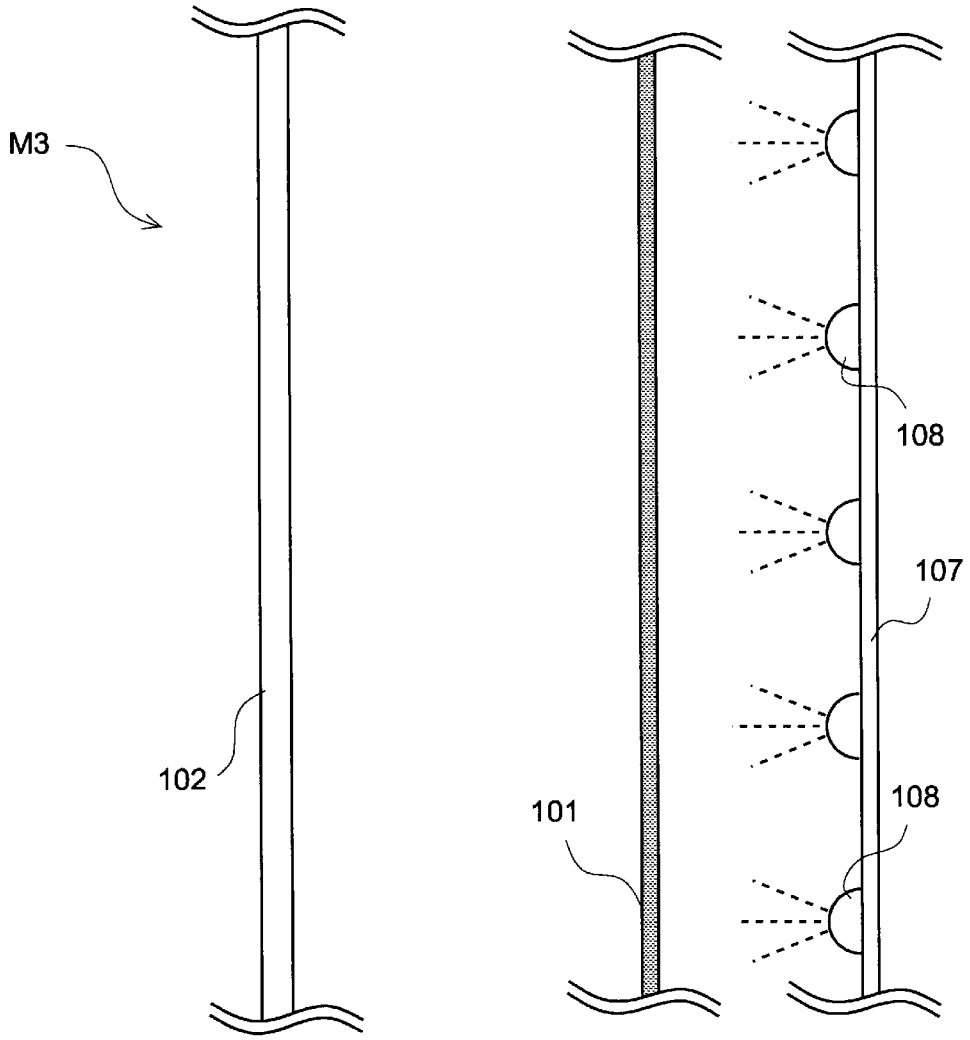
FIG. 4 is a side view of a structure of an electrostatic atomizing device of Example 3, which is used in the separation apparatus illustrated in FIG. 1.

FIG. 4 is a side view illustrating an electrostatic atomizing device M3 of Example 3.

The electrostatic atomizing device M3 of Example 3 is arranged in the atomization chamber 10, and may include a plurality of electrostatic atomizing devices M3.

The electrostatic atomizing device M3 of Example 3 also includes the surface electrode 101 and the counter electrode 102.

The surface electrode 101 in this example is made of fabric, specifically, made of woven fabric (including knits) or nonwoven fabric. Fiber strands forming the woven fabric or the nonwoven fabric may include any of a strand of a natural fiber and a strand of a synthetic fiber. Alternatively, the fiber strands may include strands of conductive fibers such as a metal fiber and a carbon fiber.

Although the surface electrode 101 in this example has a rectangular shape, other shapes may be employed. The surface electrode 101 is suspended in the atomization chamber 10 by an appropriate method such as a method of connecting one side of the surface electrode 101 to a ceiling so that the surface electrode 101 is suspended from the ceiling.

The counter electrode 102 is a metal plate made of a conductive metal. The counter electrode 102 is stood on the floor of the atomization chamber 10 by an appropriate method. The counter electrode 102 and the surface electrode 101 are connected to each other with a conductive wire (not shown) so that a predetermined electric field is formed as well between the counter electrode 102 and the surface electrode 101 by an electric power source (not shown). Although the counter electrode 102 in this example has a rectangular shape of the same size as that of the surface electrode 101, other shapes and sizes may be employed. Further, although the counter electrode 102 in this example is arranged parallel to the surface electrode 101 while being aligned with the surface electrode 101 in front view, other arrangements may be employed.

On a back surface side of the surface electrode 101, there are arranged a pipe 107 connected to the connecting pipes 1A and diffusers 108 fixed to the pipe 107. The diffusers 108 diffuse the solution L supplied from the storage tank 11 through the connecting pipes 1A and the pipe 107 to the surface electrode 101 from the back surface side thereof. The solution L thus diffused permeates into the surface electrode 101, and seeps from the entire front surface of the surface electrode 101 through gaps among the fiber strands forming the woven fabric or the nonwoven fabric.

The solution L, which seeps onto the front surface of the surface electrode 101, adheres to the fiber strands forming the surface electrode 101 made of the woven fabric or the nonwoven fabric, and is spread into a thin film shape. The solution L spread in a thin film form on the surface electrode 101 is atomized into fine particles as in the electrostatic atomizing device M1 of Example 1.

The fine particles and the gas of the solution L are sent to the classifier 20 through the connecting pipe 1B.

Note that, when the electrostatic atomizing device M3 of Example 3 is operated, the solution L drips onto the floor of an interior space of the atomization chamber 10. When the electrostatic atomizing device M3 of Example 3 is used, some appropriate mechanism for collecting droplets of the solution L, which drip in the atomization chamber 10, needs to be provided.

When the fiber strands forming the surface electrode 101 made of the woven fabric or the nonwoven fabric are not conductive fiber strands, on the back surface side of the surface electrode 101, a conductive metal plate or a conductive metal foil may be adhered along the surface electrode 101 and connected to the conductive wire. With this, the electric field is more easily generated between the surface electrode 101 and the counter electrode 102.

Meanwhile, in this case, it is conceived that the solution L is difficult to supply to the surface electrode 101 made of the woven fabric or the nonwoven fabric from the back surface side of the surface electrode 101. In order to coat the front surface of the surface electrode 101 with the solution L in a thin film form also in this case, for example, the following configurations may be employed: preforming a hole or a slit through an appropriate part of the metal plate or the metal foil; and supplying the solution L to an uppermost portion of the woven fabric or the nonwoven fabric so that the solution L seeps onto the front surface of the surface electrode 101 made of the woven fabric or the nonwoven fabric while dripping through the surface electrode 101.

EXAMPLE 4 OF ELECTROSTATIC ATOMIZING DEVICE

Figure 5:
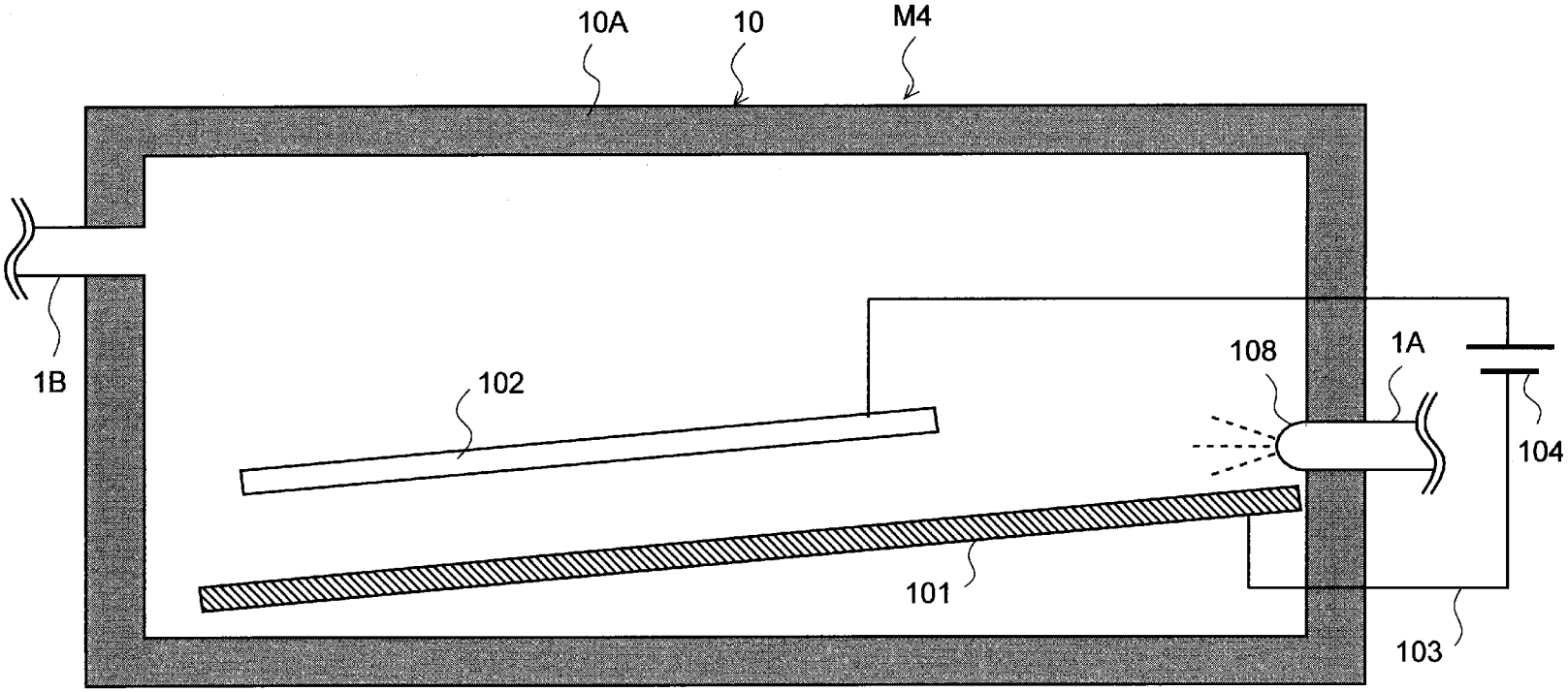
FIG. 5 is a side view of a structure of an electrostatic atomizing device of Example 4, which is used in the separation apparatus illustrated in FIG. 1.
Figure 6:
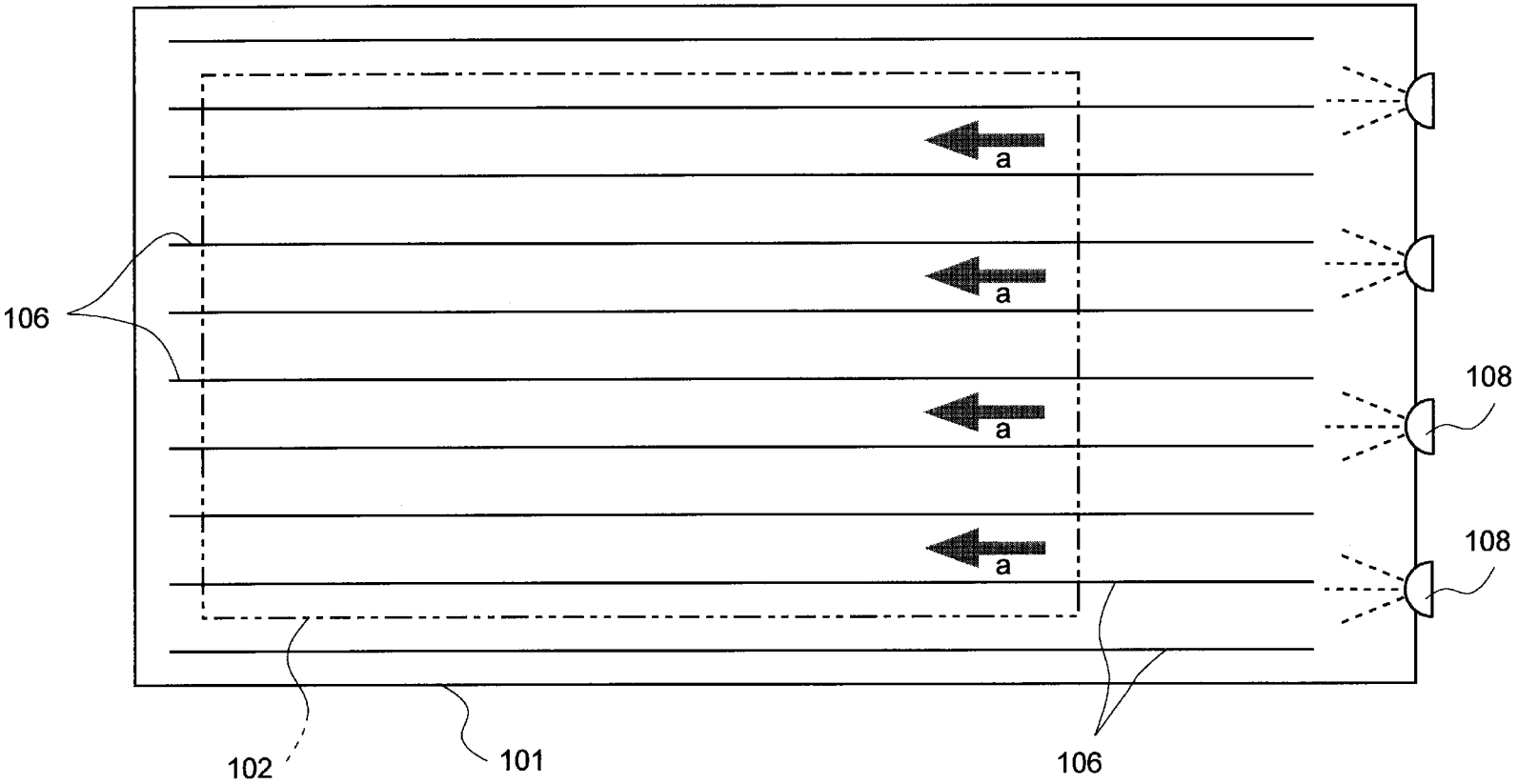
FIG. 6 is a plan view of a structure of a surface electrode illustrated in FIG. 5.

FIGS. 5 and 6 illustrate an electrostatic atomizing device M4 of Example 4, which is formed of the entire atomization chamber 10 similarly to the electrostatic atomizing device M1 of Example 1.

The connecting pipe 1A and the connecting pipe 1B are connected to the walls 10A of the atomization chamber 10.

The electrostatic atomizing device M4 of Example 4 also includes the plate-like surface electrode 101 and the counter electrode 102.

The surface electrode 101 and the counter electrode 102 in the electrostatic atomizing device M4 of Example 4 are each made of a conductive metal and each have a rectangular shape. The counter electrode 102 is one size smaller than the surface electrode 101. Surfaces of the surface electrode 101 and the counter electrode 102 facing each other are parallel to each other while being inclined. The grooves 106 are formed in the front surface of the surface electrode 101. The direction of the grooves 106 extends along the direction of inclination of the surface electrode 101. The depth of each of the grooves 106 is set to be 1 mm or less as in the electrostatic atomizing device M2 of Example 2. Further, the front surface of the surface electrode 101 may be provided with protrusions similar to those provided on the front surface of the surface electrode 101 of the electrostatic atomizing device M2 of Example 2.

Further, in this example, in a vicinity of one short side of the surface electrode 101, which is positioned relatively higher than another short side thereof, the plurality of diffusers 108 for diffusing the solution L received from the connecting pipes 1A are provided along the one short side. In this example, the diffusers 108 diffuse the solution L over the entire portion in the short side direction of the surface electrode 101.

A blower (not shown) blows wind in the direction indicated by arrows "a" in FIG. 6 along the direction of inclination of the surface electrode 101 onto the front surface of the surface electrode 101 of the electrostatic atomizing device M4 of Example 4.

In the electrostatic atomizing device M4 of Example 4, the solution L diffused by the diffusers 108 becomes thinner by being spread in a thin film form while dripping along the front surface of the surface electrode 101 in accordance with the inclination of the surface electrode 101. The grooves 106 and the air blown by the blower promote the spread of the solution L into the thin film form and movement of the solution L spread into the thin film form.

An electric field is generated between the surface electrode 101 and the counter electrode 102. The solution L, which is spread in a thin film form on the front surface of the surface electrode 101, is atomized into fine particles as in the electrostatic atomizing device M1 of Example 1.

The fine particles and the gas of the solution L are sent to the classifier 20 through the connecting pipe 1B.

EXAMPLE 5 OF ELECTROSTATIC ATOMIZING DEVICE

Figure 7:
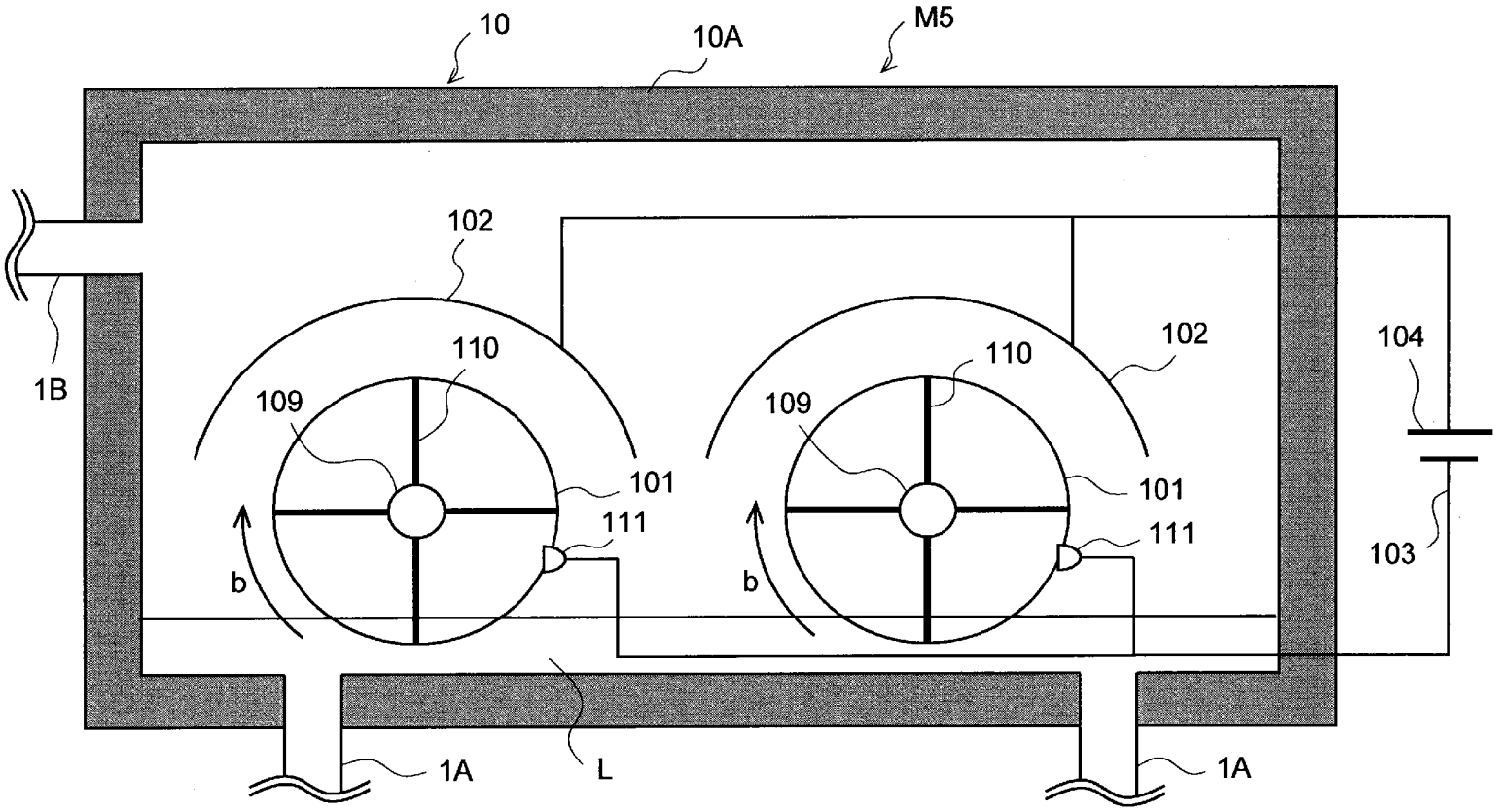
FIG. 7 is a side view of a structure of an electrostatic atomizing device of Example 5, which is used in the separation apparatus illustrated in FIG. 1.
Figure 8:
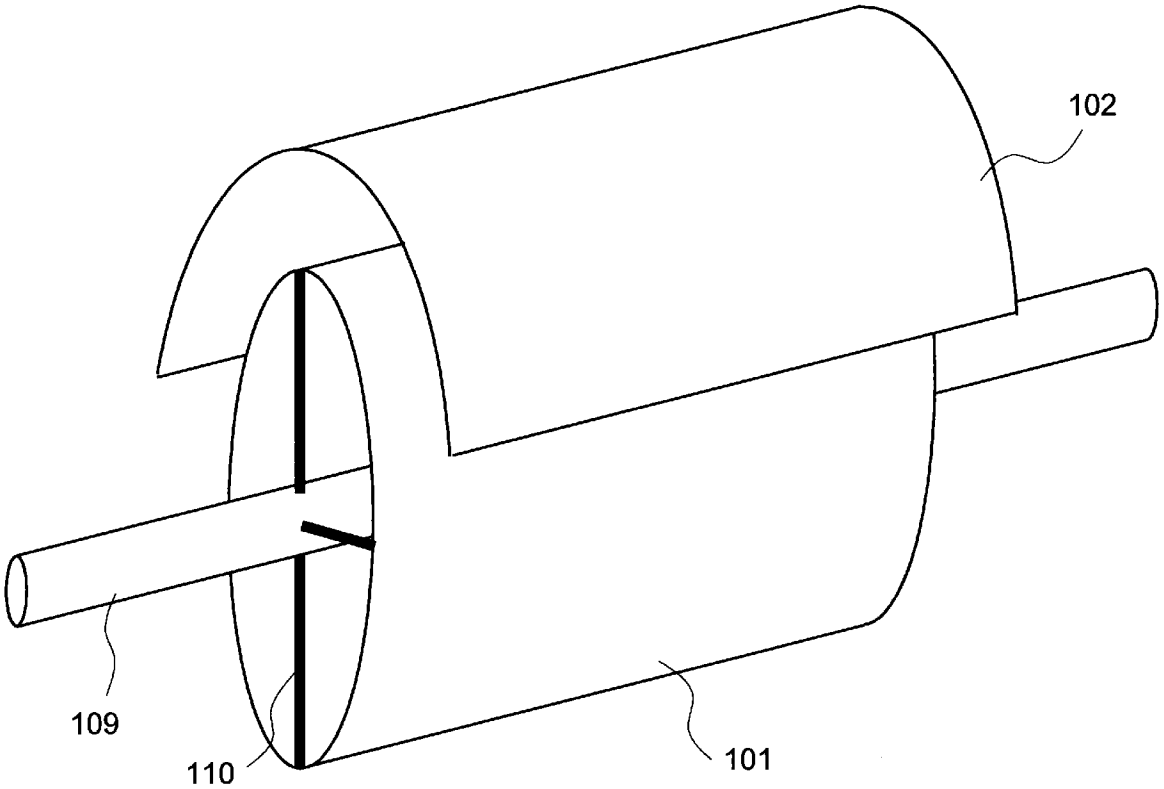
FIG. 8 is a perspective view of a structure of a surface electrode illustrated in FIG. 7.

FIGS. 7 and 8 illustrate an electrostatic atomizing device M5 of Example 5, which is formed of the entire atomization chamber 10 similarly to the electrostatic atomizing device M1 of Example 1.

The connecting pipes 1A and the connecting pipe 1B are connected to the walls 10A of the atomization chamber 10. The connecting pipes 1A are connected to the floor part of the walls 10A, and the solution L is pooled by a predetermined depth on the floor part.

The electrostatic atomizing device M5 of Example 5 includes two pairs of a surface electrode 101 having a cylindrical shape, and a counter electrode 102 facing a part of the cylindrical surface electrode 101 and having an inner surface in conformity with the cylindrical surface electrode 101. The front surface in the present invention corresponds to a cylindrical outer surface of the cylindrical surface electrode 101. Although a length of the cylindrical surface electrode 101 and a length of the counter electrode 102 (lengths in a depth direction in FIGS. 7 and 8) are equal to each other, those length may be different from each other. The cylindrical surface electrode 101 and the counter electrode 102 are each made of a conductive metal.

In this example, the surface electrode 101 is fixed to a shaft 109 through intermediation of metal support rods 110. Both ends of the shaft 109 are supported by predetermined bearings (not shown) so that the shaft 109 can be rotated by predetermined power. The surface electrode 101 is rotated in a direction indicated by an arrow "b" in FIG. 7 along with rotation of the shaft 109.

The front surface of the surface electrode 101 is a smooth surface, and may be provided with a large number of protrusions. Further, the hydrophobic layer or the hydrophilic layer may be provided on the front surface of the surface electrode 101.

The surface electrodes 101 and the counter electrodes 102 are connected to the electric power source 104 through intermediation of the conductive wires 103 so that an electric field is generated between the surface electrode 101 and the counter electrode 102 in each pair. The counter electrode 102 and the conductive wire 103 can be connected to each other by general methods. Meanwhile, the conductive wire 103 and the surface electrode 101 are connected to each other with a brush electrode 111 in consideration of the rotation of the surface electrode 101. Note that, as a matter of course, a part of the conductive wire 103, which is immersed in the solution L, is insulated.

When the surface electrode 101 as described above is rotated in the direction of the arrow "b" in FIG. 7, the solution L adheres in a thin film form to an inner peripheral surface and the outer peripheral surface of the surface electrode 101. Along with the rotation of the surface electrode 101, when coming to a part between the surface electrode 101 and the counter electrode 102, at which the electric field is generated, the solution L in a thin film form, which adheres to the outer peripheral surface of the surface electrode 101, is atomized into fine particles as in the electrostatic atomizing device M1 of Example 1.

The fine particles and the gas of the solution L are sent to the classifier 20 through the connecting pipe 1B.

Note that, the liquid surface of the solution L is adjusted so that a lower side of the surface electrode 101 is always immersed in the solution L and that the brush electrode 111 is not coated with the liquid surface of the solution L.

EXAMPLE 6 OF ELECTROSTATIC ATOMIZING DEVICE

Figure 9:
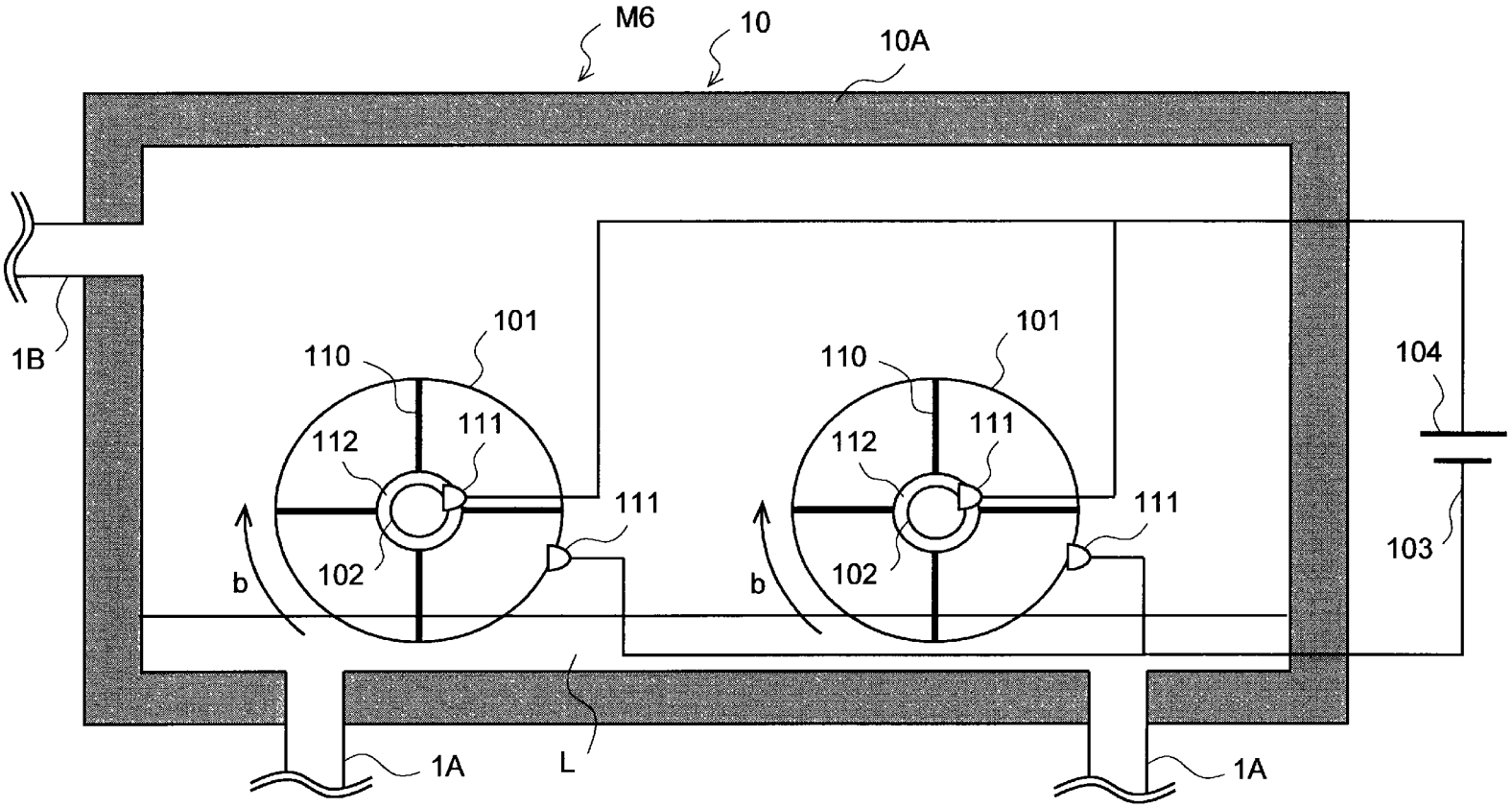
FIG. 9 is a side view of a structure of an electrostatic atomizing device of Example 6, which is used in the separation apparatus illustrated in FIG. 1.
Figure 10:
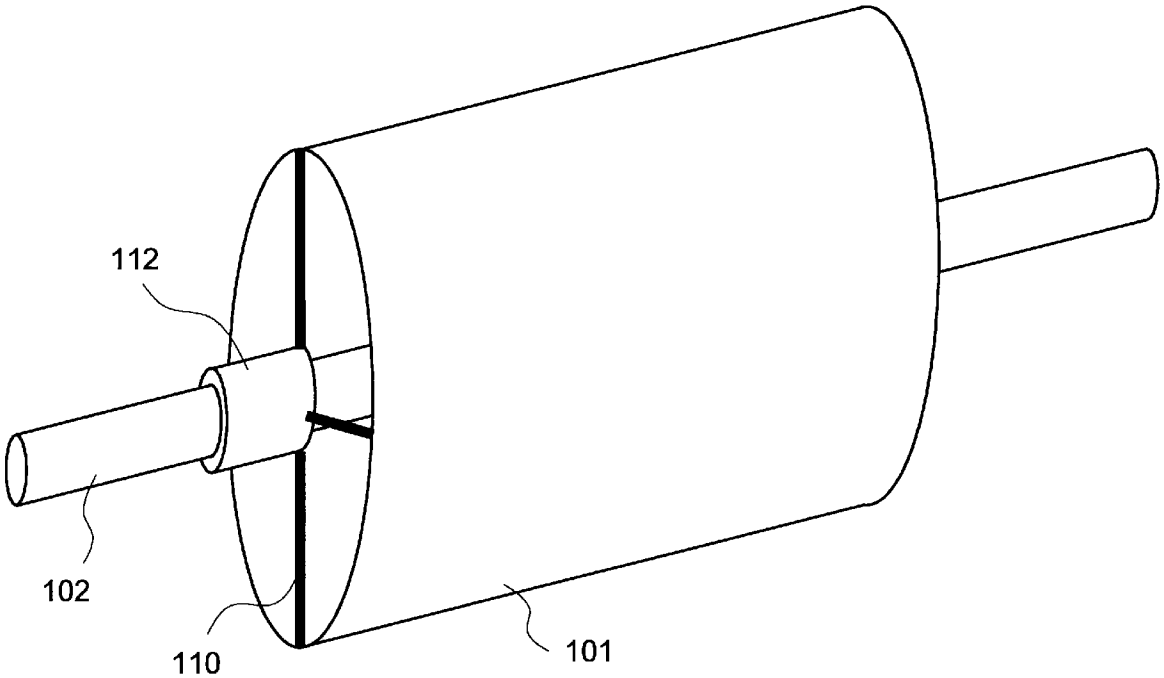
FIG. 10 is a perspective view of a structure of a surface electrode illustrated in FIG. 9.

FIGS. 9 and 10 illustrate an electrostatic atomizing device M6 of Example 6, which is formed of the entire atomization chamber 10 similarly to the electrostatic atomizing device M1 of Example 1.

The connecting pipe 1A and the connecting pipe 1B are connected to the walls 10A of the atomization chamber 10. The structure of the connecting pipe 1A and how to adjust the depth of the solution L are the same as those in the description of the electrostatic atomizing device M5 of Example 5.

Similarly to the electrostatic atomizing device M5 of Example 5, the electrostatic atomizing device M6 of Example 6 includes two pairs of cylindrical surface electrodes 101 each made of a conductive metal. The front surface in the present invention corresponds to the inner surface of the cylindrical surface electrode 101.

The surface electrode 101 is fixed to a counter electrode 102 which is made of a conductive metal and doubles as a shaft through intermediation of the support rods 110. Note that, the support rods 110 and the counter electrode 102 doubling as a shaft are connected to each other through intermediation of an insulating ring 112 formed of a ring-shaped insulating member. Thus, even when the support rods 110 are conductive, the surface electrode 101 and the counter electrode 102 are not conducted to each other. Therefore, as described below, an electric field is generated between the surface electrode 101 and the counter electrode 102.

As in the electrostatic atomizing device M5 of Example 5, both ends of the counter electrode 102 can be supported and rotated by bearings, and hence the surface electrode 101 is rotated in the direction indicated by the arrow "b" in FIG. 9 as well.

The front surface of the surface electrode 101 is a smooth surface, and may be provided with a large number of protrusions. Further, the hydrophobic layer or the hydrophilic layer may be provided on the front surface of the surface electrode 101.

The surface electrodes 101 and the counter electrodes 102 are connected to the electric power source 104 via the conductive wires 103 so that an electric field is generated between the surface electrode 101 and the counter electrode 102 in each pair. As in the electrostatic atomizing device M5 of Example 5, the conductive wire 103 and the surface electrode 101 are connected to each other with the brush electrode 111 in consideration of the rotation of the surface electrode 101. However, in the electrostatic atomizing device M6 of Example 6, also in consideration of the rotation of the counter electrode 102 doubling as the shaft, the counter electrode 102 and the conductive wire 103 are connected to each other also with the brush electrode 111.

When the surface electrode 101 as described above is rotated in the direction of the arrow "b" in FIG. 9, the solution L adheres in a thin film form to the inner peripheral surface and the outer peripheral surface of the surface electrode 101. By an electric field between the surface electrode 101 and the counter electrode 102, the solution L in a thin film form, which adheres to the inner peripheral surface of the surface electrode 101, is atomized into fine particles as in the electrostatic atomizing device M1 of Example 1. Note that, at a lower part of the surface electrode 101, a thickness of the solution L thereon is large, and hence fine particles of the solution L are not virtually generated from this part.

The fine particles and the gas of the solution L are sent to the classifier 20 through the connecting pipe 1B.

Note that, in the above description of this example, the counter electrode 102 doubles as a shaft, but it is unnecessary to provide a function of the counter electrode 102 to the shaft, and an electrode separated from the shaft may be provided inside the cylindrical surface electrode 101.

EXAMPLE 7 OF ELECTROSTATIC ATOMIZING DEVICE

Figure 11:
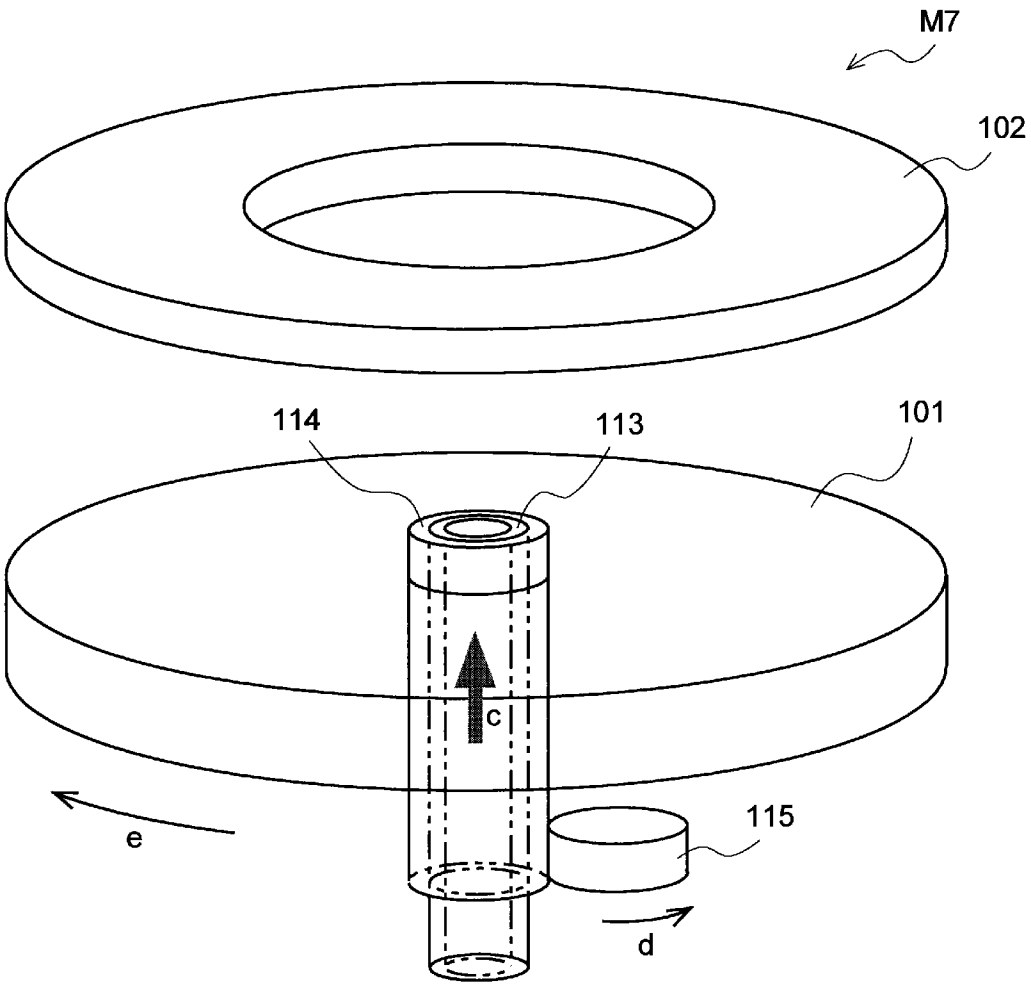
FIG. 11 is a perspective view of a structure of an electrostatic atomizing device of Example 7, which is used in the separation apparatus illustrated in FIG. 1.

FIG. 11 illustrates an electrostatic atomizing device M7 of Example 7. The electrostatic atomizing device M7 may include a plurality of electrostatic atomizing devices M7 arranged in the atomization chamber 10.

The electrostatic atomizing device M7 includes a supply pipe 113 stood upright with respect to the floor. The supply pipe 113 is a metal pipe, and the solution L is supplied as indicated by an arrow "c" from the storage tank 11 through the connecting pipe 1A connected to a lower end of the supply pipe 113. An upper end of the supply pipe 113 is opened so that the solution L is allowed to overflow from the upper end of the supply pipe 113.

A rotary pipe 114, which is a cylindrical member provided to surround an outside of the supply pipe 113, is fixed to the supply pipe 113. In this example, the rotary pipe 114 is made of a metal, and a gap is substantially perfectly closed between an inner peripheral surface of the rotary pipe 114 and an outer peripheral surface of the supply pipe 113. An outer peripheral surface of the rotary pipe 114 is connected to a rotator 115 connected to a predetermined drive apparatus so that the rotary pipe 114 is rotated in a direction of an arrow "e" along with rotation in a direction of an arrow "d" of the rotator 115.

Further, the electrostatic atomizing device M7 also includes the surface electrode 101 and the counter electrode 102.

The surface electrode 101 has a disk-like shape. The front surface of the surface electrode 101, which corresponds to an upper surface thereof, is horizontal. An inner peripheral surface of a hole formed through a center of the surface electrode 101 is fixed to the outer peripheral surface of the rotary pipe 114. The surface electrode 101 is coaxial with the supply pipe 113 and the rotary pipe 114, and hence, along with the rotation of the rotary pipe 114, the surface electrode 101 is rotated about a perpendicular line extending through the center. After the solution L overflows from the upper end of the supply pipe 113 as described above, the solution L reaches the front surface of the surface electrode 101 by way of an upper surface of the supply pipe 113, an upper surface of the rotary pipe 114, and a side surface of the rotary pipe 114. Then, the solution L is moved on the front surface of the surface electrode 101 by a centrifugal force to an outer side in a radial direction. In this way, the solution L is spread in a thin film form over the front surface of the surface electrode 101.

The upper surface of the surface electrode 101 is a smooth surface, and may be provided with a large number of protrusions. Further, the hydrophobic layer or the hydrophilic layer may be provided on the front surface of the surface electrode 101. Further, although not shown, the front surface of the surface electrode 101 may be provided with a plurality of grooves formed along the radial direction.

Meanwhile, the counter electrode 102 is provided above the surface electrode 101 at a predetermined clearance with respect to the surface electrode 101. Although the counter electrode 102 is made of a conductive metal, other materials may be employed. The counter electrode 102 is formed of a doughnut-shaped disk. An outer diameter of the counter electrode 102 is equal to the outer diameter of the surface electrode 101, and in plan view, a center of the counter electrode 102 is aligned with the center of the surface electrode 101. The front surface of the counter electrode 102, which corresponds to a lower surface thereof, is parallel to the front surface of the surface electrode 101.

The surface electrode 101 and the counter electrode 102 are connected to an electric power source via conductive wires (not shown) so that an electric field is generated between the surface electrode 101 and the counter electrode 102. In consideration of the rotation of the surface electrode 101, the conductive wire and the surface electrode 101 are connected to each other with, for example, a brush electrode held in abutment against a side surface of the surface electrode 101 or the outer peripheral surface of the rotary pipe 114.

When the surface electrode 101 as described above is rotated in the direction of the arrow "e" in FIG. 11, the solution L in a thin film form is spread and is coated onto the front surface of the surface electrode 101. When the solution L in a thin film form advances on the front surface of the surface electrode 101 to an outside and comes close to below the counter electrode 102, the solution L is atomized into fine particles as in the electrostatic atomizing device M1 of Example 1. Note that, the counter electrode 102 is provided so as to correspond to, in plan view, a part of the surface electrode 101 on an outer periphery side. This is because a thickness of the solution L in a thin film form on the front surface of the surface electrode 101 is smaller and more stable on a part closer to the outer peripheral part of the surface electrode 101, and hence the solution L can be easily atomized into fine particles.

The fine particles and the gas of the solution L are sent to the classifier 20 through the connecting pipe 1B.

Note that, the upper surfaces of the supply pipe 113 and the rotary pipe 114 may be flush with the front surface of the surface electrode 101. Further, it is not necessary to supply the solution L from the supply pipe 113 doubling as the shaft for rotating the surface electrode 101, and the solution L may be supplied from above the surface electrode 101 to a vicinity of the center of the front surface of the surface electrode 101.

Further, the solution L drips downward from the outer periphery of the surface electrode 101, and hence an appropriate mechanism for collecting droplets of the solution L, which drip in the atomization chamber 10, needs to be provided, for example, on the floor of the atomization chamber 10.

EXAMPLE 8 OF ELECTROSTATIC ATOMIZING DEVICE

Figure 12:
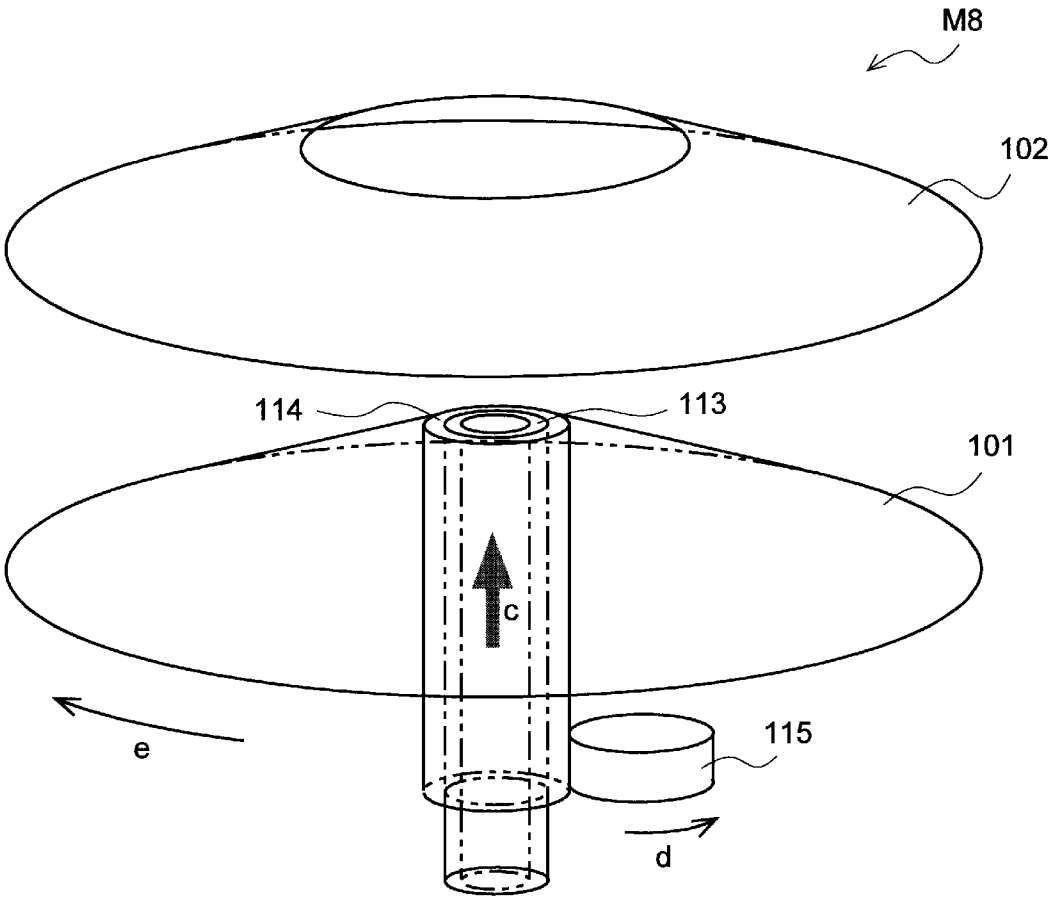
FIG. 12 is a perspective view of a structure of an electrostatic atomizing device of Example 8, which is used in the separation apparatus illustrated in FIG. 1.

FIG. 12 illustrates an electrostatic atomizing device M8 of Example 8. The electrostatic atomizing device M8 may include a plurality of electrostatic atomizing devices M8 arranged in the atomization chamber 10.

The electrostatic atomizing device M8 of Example 8 has substantially the same structure as that of the electrostatic atomizing device M7 of Example 7 except that the surface electrode 101 has a different shape and the counter electrode 102 is formed into a different shape in conformity with the changed shape of the surface electrode 101.

The electrostatic atomizing device M8 of Example 8 includes the supply pipe 113, the rotary pipe 114, and the rotator 115, which are the same as those of the electrostatic atomizing device M7 of Example 7. Those components have the same functions as those of the electrostatic atomizing device M7 of Example 7.

Unlike the disk-like surface electrode 101 of the electrostatic atomizing device M7 of Example 7, the surface electrode 101 of the electrostatic atomizing device M8 of Example 8 has a conical shape. Specifically, the surface electrode 101 has an upper end corresponding to a rim of the rotary pipe 114. Thus, more strictly speaking, the surface electrode 101 has a truncated conical shape almost like a conical shape. The inner peripheral surface of the hole formed through the center of the surface electrode 101 is fixed to the outer peripheral surface of the rotary pipe 114. The entire periphery of the surface electrode 101 is formed of an inclined surface inclined to the outside.

The inclined surface of the surface electrode 101 corresponds to the front surface of the surface electrode 101 of the electrostatic atomizing device M8. The front surface of the surface electrode 101 is a smooth surface, and may be provided with a large number of protrusions. Further, the hydrophobic layer or the hydrophilic layer may be provided on the front surface of the surface electrode 101. Further, although not shown, the front surface of the surface electrode 101 may be provided with a plurality of grooves formed along the radial direction.

Meanwhile, the counter electrode 102 is provided above the surface electrode 101 at a predetermined clearance with respect to the surface electrode 101. Although the counter electrode 102 is made of a conductive metal, other materials may be employed. The counter electrode 102 is a plate having a shape formed in conformity with a side surface of the truncated conical shape. An outer diameter of the counter electrode 102 is equal to the outer diameter of the surface electrode 101, and in plan view, a center of the counter electrode 102 is aligned with the center of the surface electrode 101. The front surface of the counter electrode 102, which corresponds to a lower inclined surface thereof, is parallel to the front surface of the surface electrode 101.

The surface electrode 101 and the counter electrode 102 are connected to an electric power source via conductive wires (not shown) so that an electric field is generated between the surface electrode 101 and the counter electrode 102. In consideration of the rotation of the surface electrode 101, the conductive wire 103 and the surface electrode 101 are connected to each other with, for example, a brush electrode held in abutment against an appropriate part of the inclined surface of the surface electrode 101 or the outer peripheral surface of the rotary pipe 114.

When the surface electrode 101 as described above is rotated in the direction of the arrow "e" in FIG. 12, the solution L in a thin film form is spread and is coated onto the front surface of the surface electrode 101. When the solution L in a thin film form advances on the front surface of the surface electrode 101 to an outside and comes close to below the counter electrode 102, the solution L is atomized into fine particles as in the electrostatic atomizing device M1 of Example 1.

The fine particles and the gas of the solution L are sent to the classifier 20 through the connecting pipe 1B.

Note that, it is not necessary to supply the solution L from the supply pipe 113 doubling as the shaft for rotating the surface electrode 101, and the solution L may be supplied from above the surface electrode 101 to a vicinity of the center of the front surface of the surface electrode 101.

Further, the solution L drips downward from the outer periphery of the surface electrode 101, and hence an appropriate mechanism for collecting droplets of the solution L, which drip in the atomization chamber 10, needs to be provided, for example, on the floor of the atomization chamber 10.

Note that, the surface electrode 101 is formed of a rotator. More specifically, the surface electrode 101 is formed into a shape of a rotator obtained by rotating, about the Y-axis in a coordinate system, a segment in the first quadrant such as a straight line, a curve, and a combination of the straight line and the curve, the segment having a slope of zero or less at each coordinate point between the X-axis and the Y-axis and having both ends respectively intersecting with the X-axis and the Y-axis.

Figure 13A:
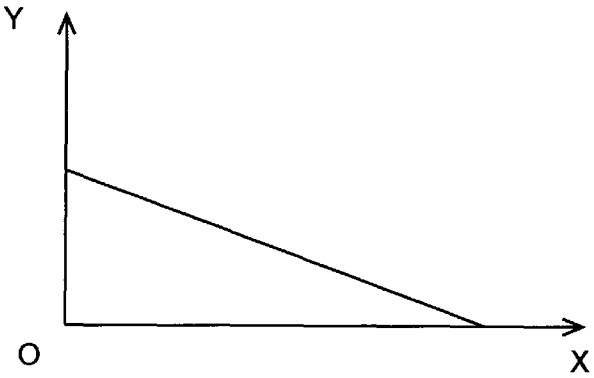
FIGS. 13A to 13D are graphs illustrating how to form a shape of a surface electrode that can be used in the electrostatic atomizing device illustrated in FIG. 12.
Figure 13B:
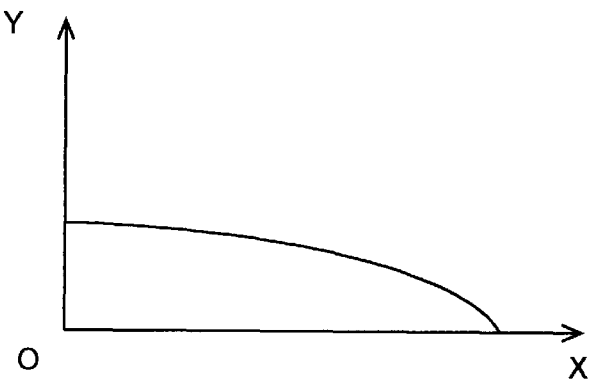
Figure 13C:
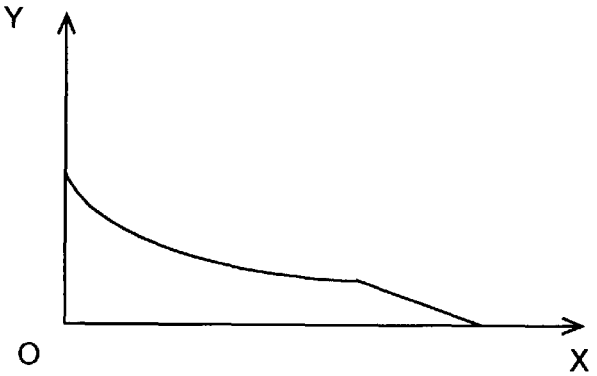
Figure 13D:
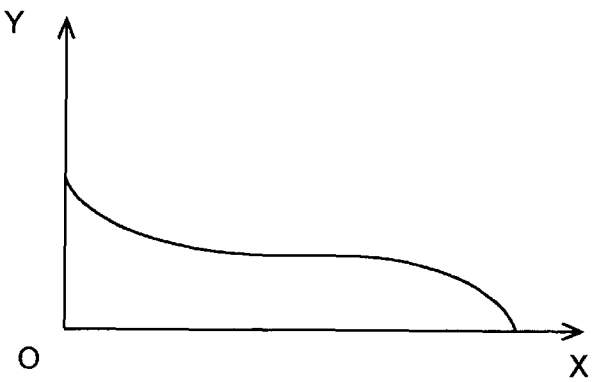

For example, the rotator obtained as described above in this example corresponds to a rotator obtained by rotating a segment, which is a straight line indicated in FIG. 13A, about the Y-axis. The segment is not necessarily a straight line, and may include a curve as indicated in FIG. 13B, and combinations of a straight line and a curve as indicated in FIGS. 13C and 13D. As indicated in FIG. 13D, the segment may have a part with a slope of zero as long as there is no part with the slope of a positive value.

EXAMPLE 9 OF ELECTROSTATIC ATOMIZING DEVICE

An electrostatic atomizing device M9 of Example 9 is configured as follows.

Figure 14:
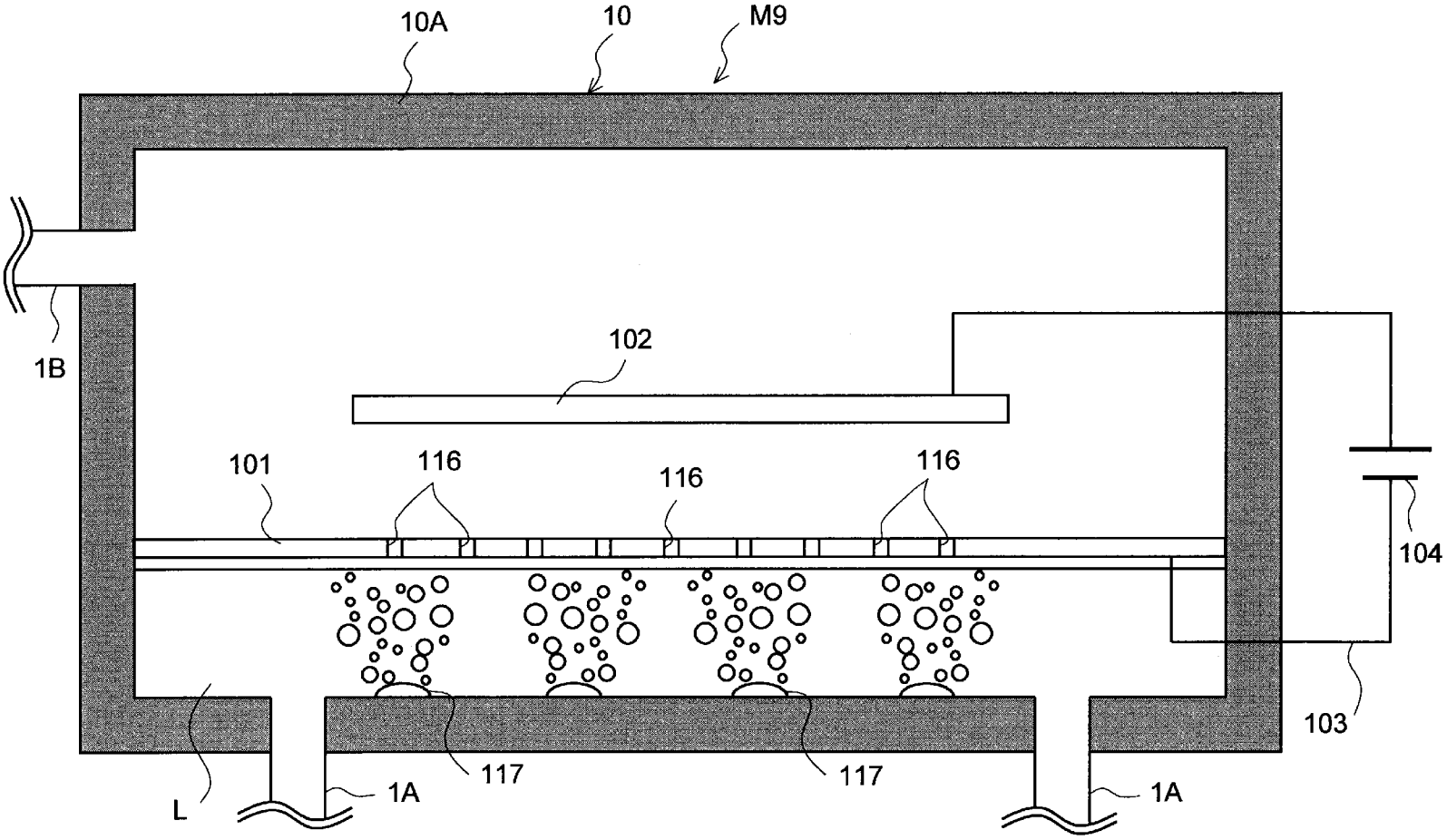
FIG. 14 is a side view of a structure of an electrostatic atomizing device of Example 9, which is used in the separation apparatus illustrated in FIG. 1.

FIG. 14 illustrates the electrostatic atomizing device M9 of Example 9, which is formed of the entire atomization chamber 10.

Similarly to the electrostatic atomizing device M1 of Example 1, in the electrostatic atomizing device M9 of Example 9, the connecting pipes 1A and the connecting pipe 1B are connected to the atomization chamber 10.

The surface electrode 101 provided in the atomization chamber 10 has a rectangular plate-like shape. The surface electrode 101 is horizontally arranged, and as in the electrostatic atomizing device M1 of Example 1, has the four sides fixed to the walls 10A.

Although the mesh shape may be employed as in the electrostatic atomizing device M1 of Example 1, the surface electrode 101 of the electrostatic atomizing device M9 of Example 9 is formed of a plate provided with a large number of holes 116 formed therethrough. The front surface corresponds to an upper surface of the surface electrode 101. Although not necessarily, the front surface of the surface electrode 101 is horizontal. The surface electrode 101 in this example is formed of a conductive metal.

The front surface of the surface electrode 101 may be coated with a hydrophobic layer or a hydrophilic layer. It is preferred to set diameters of the holes 116 to be, for example, ten times to one hundred times as large as diameters of droplets. When the holes are small to this extent, the droplets which pass through the holes 116 can be selected to some extent based on a ratio of a solvent and a solute.

The counter electrode 102 provided in the atomization chamber 10 is formed into a plate-like shape as in the electrostatic atomizing device M1 of Example 1. The surface electrode 101 and the counter electrode 102 are connected to the electric power source 104 via the conductive wires 103 so that a predetermined potential difference is generated therebetween. With this, an electrostatic field is generated between the surface electrode 101 and the counter electrode 102.

The solution L is supplied from the storage tank 11 into the atomization chamber 10 through the connecting pipes 1A. Unlike the case in the electrostatic atomizing device M1 of Example 1, the liquid surface of the solution L is kept slightly lower than the surface electrode 101, and the part forming the floor of the walls 10A of the atomization chamber 10 is provided with a plurality of air diffusing devices 117 for blowing air bubbles. With this, a part of the solution L bubbles up from the liquid surface of the solution L. The part of the solution L, which bubbles up from the liquid surface of the solution L, comes close to the front surface of the surface electrode 101 through the holes 116, on which the electric field is generated by the potential difference between the surface electrode 101 and the counter electrode 102.

A thickness of the bubbles of the solution L is markedly small. Thus, the solution L, which exists in a bubble form in the electric field, is atomized into fine particles by the electric field as in the case where the solution L is spread in a thin film form on the front surface of the surface electrode 101.

The fine particles and the gas thus generated of the solution L are sent to the classifier 20 through the connecting pipe 1B.

In the electrostatic atomizing device M9 , the solution L is pooled below the surface electrode 101, and the solution L is bubbled with the air diffusing devices 117 so that the solution L reaches the front surface side of the surface electrode 101 through the holes 116 of the surface electrode 101.

Figure 15:
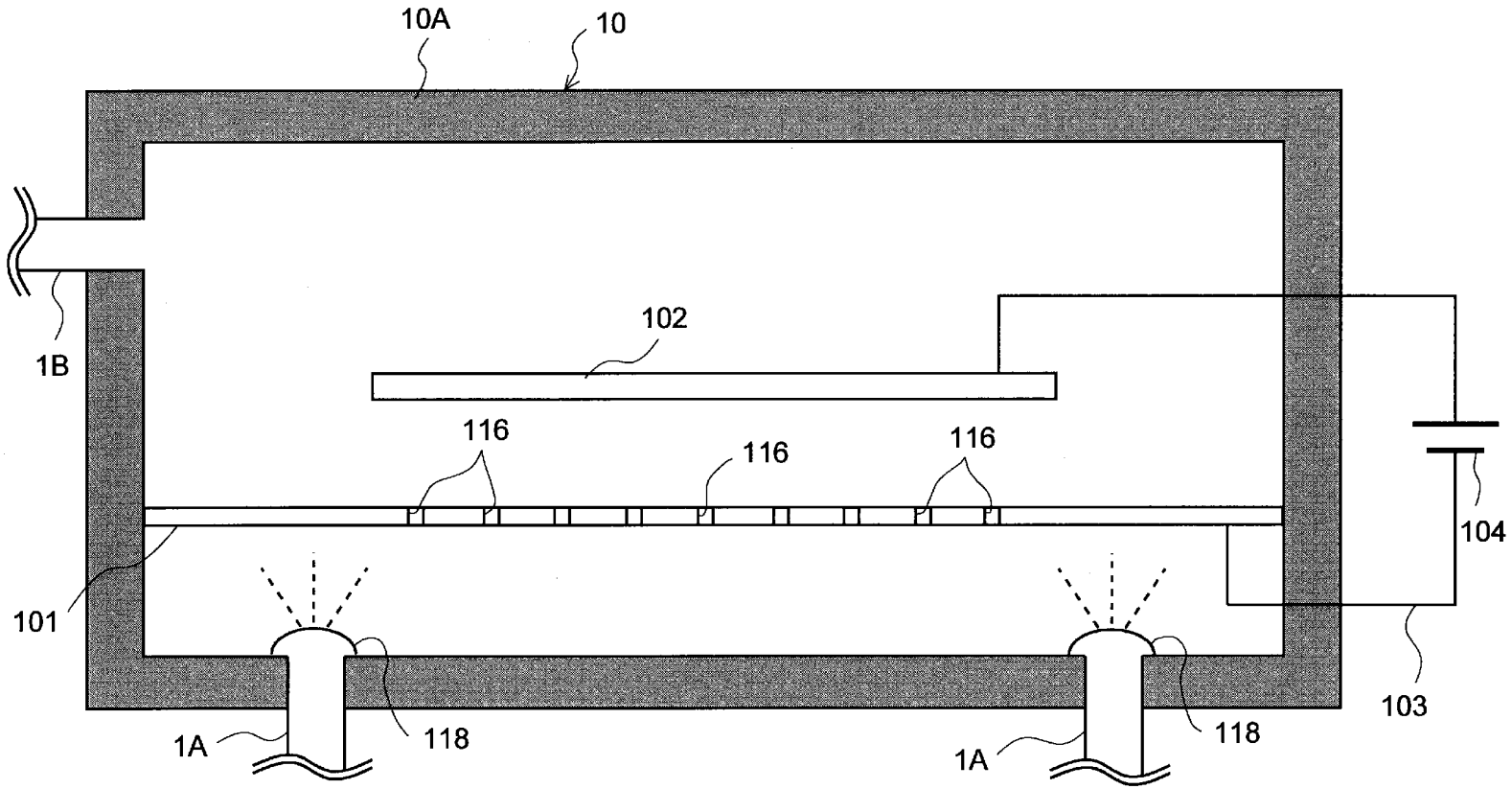
FIG. 15 is a side view of another structure of the electrostatic atomizing device of Example 9, which is used in the separation apparatus illustrated in FIG. 1.

However, as illustrated, for example, in FIG. 15, the solution L may be divided into droplets by sprays 118 for dividing the solution L into fine droplets so that the solution L in the droplet form reaches the front surface side of the surface electrode 101 through the holes 116 of the surface electrode 101. As a matter of course, means for dividing the solution L into droplets is not limited to the sprays 118.

The droplets have diameters, for example, of from about 0.001 mm to 1 mm. The droplets having the sizes within this range are further finely divided by the electric field similarly to the solution L spread on the surface electrode 101 in a thin film form. With this, also in this case, fine particles of the solution L are generated.

As described above, fine particles of the solution L are generated in the atomization chamber 10, and the gas containing those fine particles is sent to the classifier 20.

Next, description is made of an operation and how to use the separation apparatus.

In the separation apparatus, as described above, fine particles of the solution L are generated in the atomization chamber 10, and the fine particles are sent to the classifier 20 together with the gas generated in the atomization chamber 10.

Sizes of the fine particles of the solution L, which are generated in the atomization chamber 10, vary in a manner of distributing within a range of from 1 nm to 10 μm. Note that, the sizes of the fine particles are not necessarily limited to this range. This variation does not follow a normal distribution, and follows a distribution in which the number of fine particles having a given size is apparently larger than the numbers of fine particles having sizes close to the given size. Specifically, in a graph in which the abscissa axis represents sizes of fine particles and the ordinate axis represents the number of the fine particles having the corresponding sizes, a peak of the number of fine particles having a given size and another peak of the number of other fine particles having another given size are formed, and normal distribution curves respectively having those peaks are overlapped with each other at their skirts. In general, approximately two to three peaks are formed.

The classifier 20 collects fine particles larger than a predetermined reference size from among the fine particles contained in the gas sent from the atomization chamber 10 together with the fine particles. When two peaks are formed, in general, the predetermined reference size in this case is set between the two peaks. With this, fine particles having different sizes are roughly divided into groups based on the numbers of the particles, which correspond respectively to the normal distribution curves of the peaks.

Further, when three peaks are formed, the predetermined reference size is set normally between a peak of a smallest fine particle group and a peak of a second smallest fine particle group, or between the peak of the second smallest fine particle group and a peak of a largest fine particle group. The same applies to a case where four or more peaks are formed.

In any case, the classifier 20 captures fine particles having sizes larger than a given reference size, and sends those fine particles to the first collection tank 21 through the connecting pipe 1C. Those fine particles are liquefied and pooled as the first solution in the first collection tank 21.

Meanwhile, other fine particles and a gas containing the other fine particles, which are not captured by the classifier 20 or sent to the first collection tank 21, are sent to the second collection tank 30. The fine particles are liquefied in the second collection tank 30 by known methods, and pooled as the second solution in the second collection tank 30.

As described above, there is a correlationship between the size of the fine particles of the solution and a concentration of the solution in each of the fine particles (rate of the solute). Thus, which of the first solution and the second solution is higher in solute concentration than the other depends on types of the solute and the solvent. In any case, the first solution and the second solution are different from each other in solute concentration.

Both the first solution and the second solution described above can be assumed as the solution L described above and re-separated by the method described above. The re-separation is not limited to once, and may be repeated two or more times.

When the first solution is assumed as the solution L, variation in solute concentration of the first solution is further promoted through repeated separations. Similarly, when the second solution is assumed as the solution L, variation in solute concentration of the second solution is further promoted through repeated separations.

In the following, specific description is made of cases where separations of various solutions are performed with the separation apparatus described above.

(Case Where Solution L is Seawater)

The solution L to be separated by the separation apparatus according to the first embodiment may include seawater.

In a case where the solution L is seawater, an amount of sodium chloride contained in fine particles of the solution L, which are generated through atomization, tends to become larger in proportion to the size of the fine particles. Thus, when the solution L is seawater, much salt is transferred because large fine particles are captured by the classifier 20. As a result, a salt concentration of the first solution becomes higher than that of an original solution, and a salt concentration of the second solution becomes lower than that of the original solution. In other words, salt condensation occurs in the first solution, and seawater desalination occurs in the second solution.

In countries suffering from lack of freshwater, outlying islands, and the like, improvement in seawater desalination technology has been desired. Thus, the seawater desalination observed in the second solution has a significant meaning.

When seawater desalination through only a single separation is insufficient to obtain drinkable water, the separation as described above of the second solution as the solution L may be repeated.

Meanwhile, markedly strong salt solution can be obtained through a separation of the first solution as the solution L, in particular, through repeated separations thereof. This salt solution can be used, for example, as a raw material for salt. When unnecessary, the first solution may be disposed of.

As described above, when the separation of the second solution as the solution L is repeated two or more times, sodium chloride can be removed from the second solution. In this context, trace minerals other than the sodium chloride are condensed into the second solution. The separation of the seawater as the solution L may be performed not for the purpose of desalination but for the purpose of condensing the trace minerals.

The trace minerals other than sodium chloride can be obtained also by repeating the separation of the first solution as the solution L two or more times.

Examples of the trace minerals may include lithium (ion). Lithium ion can be condensed into the second solution through repeated separations of the second solution as the solution L.

Other trace minerals are similarly condensed into the first solution or the second solution. In general, minerals with small atomic weights are transferred onto the second solution side, and minerals with high molecular weights are transferred onto the first solution side.

(Case Where Solution Contains Non-volatile Substance)

Next, description is made of a case where the solute contained in the solution L is a non-volatile substance having a vapor pressure lower than that of water, and the solvent contained in the solution L is water. Typical examples of such a solution include wastewater, and examples of the non-volatile substance having a vapor pressure lower than that of water include at least one of salt, an amino acid, an organic acid, a surfactant, and a protein.

When the solute and the solvent as described above are used, an amount of the solute contained in fine particles of the solution L, which are formed through atomization, tends to become larger in reverse proportion to the size of the fine particles. In other words, as a result of condensation of the solute into the second solution, a concentration of the non-volatile solute of the first solution becomes lower than that of the original solution, and a concentration of the non-volatile solute of the second solution becomes higher than that of the original solution. In other words, the non-volatile solute is removed in the first solution, and the non-volatile solute is condensed in the second solution.

When focusing on the first solution, the first solution obtained through the separation is more suitable to discharge into the environment at least than the original solution. When focusing on the discharge of the first solution into the environment, the techniques described above can be regarded as a sewage treatment technique.

When contamination reduction of the first solution through only a single separation is insufficient to discharge the first solution into the environment, the separation as described above of the first solution as the solution L may be repeated.

Meanwhile, the non-volatile substance is condensed through a separation of the second solution as the solution L. When the non-volatile substance contains some reuse-worthy substances, it is appropriate to use the second solution as a material for obtaining the reuse-worthy substances. When necessary, the separation of the second solution as the solution L can be repeated at least one more time. When unnecessary, the second solution may be disposed of.

(Case Where Solution Contains Volatile Substance)

Next, description is made of a case where the solute contained in the solution L is a volatile substance having a vapor pressure higher than that of water, and the solvent contained in the solution L is water. Typical examples of such a solution include wastewater, and examples of the volatile substance having a vapor pressure higher than that of water include at least one of hydrocarbons, alcohols, esters, ethers, aldehydes, ketones, carboxylic acids, ammonia, and other VOCs.

When the solute and the solvent as described above are used, an amount of the solute contained in fine particles of the solution L, which are formed through atomization, tends to become larger in proportion to the size of the fine particles. In other words, as a result of condensation of the solute into the first solution, a concentration of the volatile solute of the second solution becomes lower than that of the original solution, and a concentration of the volatile solute of the first solution becomes higher than that of the original solution. In other words, the volatile solute is removed in the second solution, and the volatile solute is condensed in the first solution.

When focusing on the second solution, the second solution obtained through the separation is more suitable to discharge into the environment at least than the original solution. When focusing on the discharge of the second solution into the environment, the techniques described above can be regarded as a sewage treatment technique.

When contamination reduction of the second solution through only a single separation is insufficient to discharge the second solution into the environment, the separation as described above of the second solution as the solution L may be repeated.

Meanwhile, the volatile substance is condensed through a separation of the first solution as the solution L. When the volatile substance contains some reuse-worthy substances, it is appropriate to use the first solution as a material for obtaining the reuse-worthy substances. When necessary, the separation of the first solution as the solution L can be repeated at least one more time. When unnecessary, the first solution may be disposed of.

(Second Embodiment)

Figure 16:
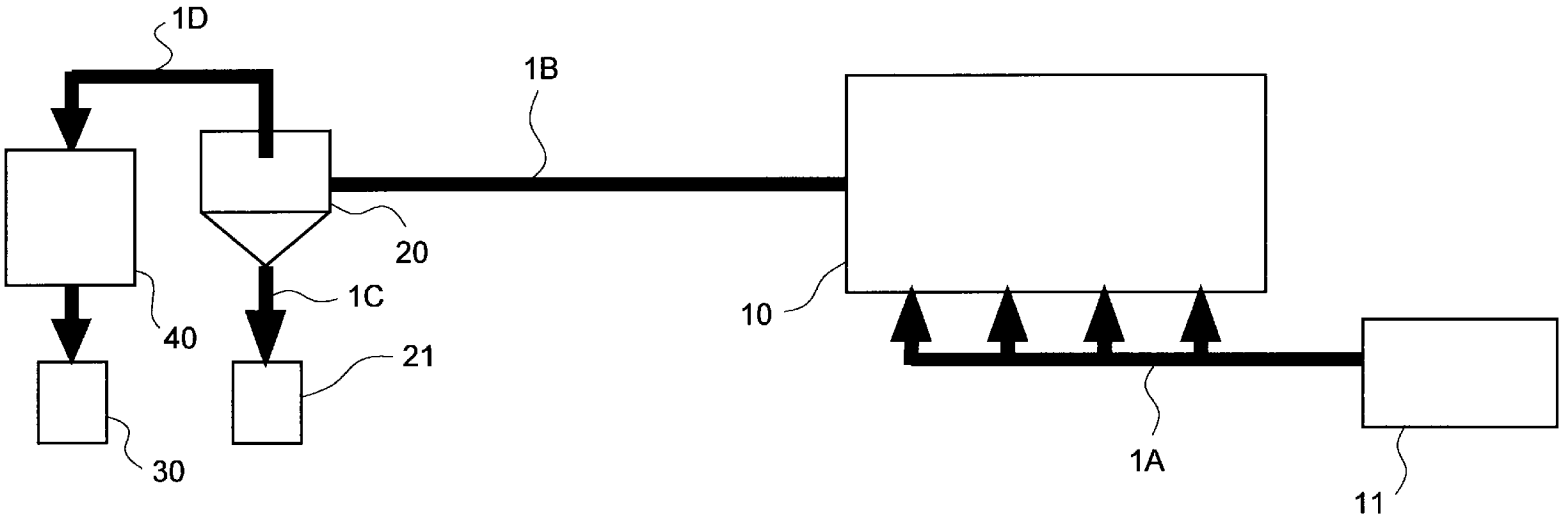
FIG. 16 is a schematic side view of an overall structure of a separation apparatus according to a second embodiment of the present invention.

FIG. 16 illustrates a separation apparatus according to a second embodiment of the present invention.

The separation apparatus according to the second embodiment has substantially the same structure as that of the separation apparatus according to the first embodiment. The separation apparatus according to the second embodiment is different from the separation apparatus according to the first embodiment in that a catalyst column 40 is provided in a midway of the connecting pipe 1D. Other structural details are the same as those of the separation apparatus according to the first embodiment.

The catalyst column 40 allows the gas, which contains the fine particles of the solution L and is sent to the second collection tank 30 through the classifier 20, to pass through the catalyst column 40 so that solutes contained in the fine particles of the solution L passing therethrough are dissolved. For dissolving the solute, the catalyst column 40 is filled, for example, with granular catalysts. The catalyst column 40 may include a known catalyst column for dissolving chemical substances to be dissolved among chemical substances passing therethrough.

The separation apparatus according to the second embodiment is capable of separating the various solutions described in the first embodiment.

Note that, the separation apparatus according to the second embodiment is useful particularly for removing, from the second solution, the solutes contained in the fine particles of the solution L sent to the second collection tank 30. Further, the separation apparatus according to the second embodiment is useful in a case where the solutes contained in the fine particles of the solution L are difficult to transfer into the second solution (transferred mainly into the first solution). In the case where the solutes contained in the fine particles of the solution L are difficult to transfer into the second solution, when the fine particles of the solution L sent to the second collection tank 30 are allowed to pass through the catalyst column 40, much smaller solutes are obtained from the second solution in the second collection tank 30. This meets the object of removing the solutes from the second solution.

In particular, when the solution L is sewage, the solute contained in water as a solvent needs to be removed. In this context, in general cases, it is necessary to finally obtain water from which solutes are removed. As described above, an amount of the solute in the second solution derived from the solution L containing a non-volatile substance as a solute and water as a solvent is reduced. In addition, it is preferred that, the solute be further reduced with the catalyst column 40, because the achievement of the above-mentioned object can be more effectively obtained. Consequently, the separation apparatus according to the second embodiment is suitable to sewage treatment, in particular, treatment of the solution containing a non-volatile substance as a solute and water as a solvent.

(Third Embodiment)

Figure 17:
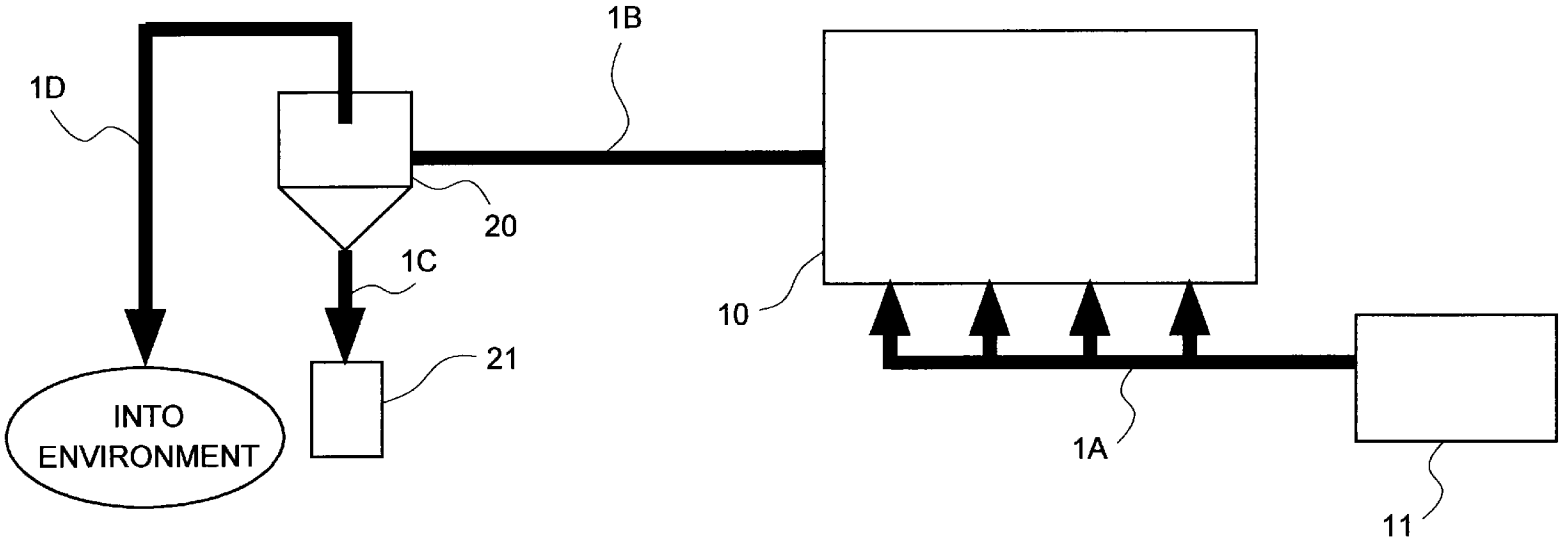
FIG. 17 is a schematic side view of an overall structure of a separation apparatus according to a third embodiment of the present invention.

FIG. 17 illustrates a separation apparatus according to a third embodiment of the present invention.

The separation apparatus according to the third embodiment has substantially the same structure as that of the separation apparatus according to the first embodiment. The separation apparatus according to the third embodiment is different from the separation apparatus according to the first embodiment in that the second collection tank 30 is not provided at the terminal of the connecting pipe 1D. Other structural details are the same as those of the separation apparatus according to the first embodiment.

In the separation apparatus according to the third embodiment, the gas containing the fine particles of the solution L, which is sent to the second collection tank 30 through the classifier 20 in the first embodiment, is directly discharged from a terminal of the connecting pipe 1D into the environment. When it is unnecessary to collect the second solution, the separation apparatus may be structured in this way.

For example, when the solution L is seawater, in order to extract salt from the seawater, it is necessary to collect the first solution having a higher salt concentration. However, it is unnecessary to collect the fine particles of the solution L, which pass through the classifier 20 and are collected in the first embodiment as the second solution having a lower salt concentration. In such a case, the separation apparatus according to the third embodiment can be used.

Note that, the catalyst column 40 described in the second embodiment may be provided in a midway of or at a terminal of the connecting pipe 1D.

The invention claimed is:

1. An electrostatic atomizing device, comprising:

a surface electrode having a two-dimensionally expanded front surface;

a counter electrode for generating a predetermined electric field between the counter electrode and the surface electrode, wherein the predetermined electric field is generated between the surface electrode and the counter electrode under a state in which the front surface of the surface electrode is coated with a solution to be atomized in a thin film form, to thereby generate fine particles of the solution from a plurality of points of a surface of the solution, which is coated onto the surface electrode;

a fluid conduit configured to convey the solution onto the front surface of the surface electrode; and a blower configured to blow a gas onto the front surface of the surface electrode, wherein the solution conveyed onto the front surface of the surface electrode advances in the thin film form in a blowing direction of the gas and is coated onto the front surface of the surface electrode.

2. An electrostatic atomizing device according to claim 1, wherein the surface electrode has a mesh shape.

3. An electrostatic atomizing device according to claim 1, wherein the surface electrode is formed of one of woven fabric and nonwoven fabric.

4. An electrostatic atomizing device according to claim 2, wherein the solution is supplied from a back surface side of the surface electrode having the mesh shape onto the front surface of the surface electrode, and wherein the fluid conduit comprises spaces in the surface electrode having the mesh shape through which the solution is conveyed so that the solution is spread in the thin film form and is coated onto the front surface of the surface electrode.

5. An electrostatic atomizing device according to claim 3, wherein the solution is supplied from a back surface side of the surface electrode formed of the one of the woven fabric and the nonwoven fabric onto the front surface of the surface electrode through gaps among fibers of the surface electrode formed of the one of the woven fabric and the nonwoven fabric so that the solution is spread in the thin film form and is coated onto the front surface of the surface electrode.

6. An electrostatic atomizing device according to claim 1, wherein the front surface of the surface electrode is horizontal, wherein the fluid conduit comprises a plurality of holes defined by the surface electrode and extending from the back surface of the surface electrode to the front surface of the surface electrode, and wherein the solution is spread in the thin film form and is coated onto the front surface of the surface electrode by being conveyed through the plurality of holes.

7. An electrostatic atomizing device according to claim 6, wherein the plurality of holes is defined along a side of the surface electrode.

8. An electrostatic atomizing device according to claim 7, wherein the side is a longitudinal side of the surface electrode.

9. An electrostatic atomizing device according to claim 1, wherein the fluid conduit comprises a diffuser.

10. An electrostatic atomizing device according to claim 1, wherein the front surface of the surface electrode is inclined, and wherein the solution conveyed onto the front surface of the surface electrode drips by gravity, advances in the thin film form, and is coated onto the front surface of the surface electrode.

11. An electrostatic atomizing device according to claim 9, wherein the diffuser is disposed at a side of the surface electrode.

12. An electrostatic atomizing device according to claim 9, wherein the fluid conduit further comprises a connecting pipe that is in fluid communication with the diffuser and is configured to convey the solution to the diffuser.

13. An electrostatic atomizing device according to claim 1, wherein the front surface of the surface electrode comprises a smooth surface.

14. An electrostatic atomizing device according to claim 13, wherein the front surface of the surface electrode is provided with a plurality of protrusions each having a height of 1 mm or less.

15. An electrostatic atomizing device according to claim 1, wherein the front surface of the surface electrode comprises a smooth surface, and is provided with a groove having a depth of 1 mm or less in a direction along an advancing direction in which the solution advances in the thin film form.

16. An electrostatic atomizing device according to claim 1, wherein the solution in the thin film form has a thickness of from 0.1 mm to 2.0 mm.

17. An electrostatic atomizing device, comprising:

a surface electrode having a two-dimensionally expanded front surface, the surface electrode being formed into a plate-like shape; and a counter electrode for generating a predetermined electric field between the counter electrode and the surface electrode, wherein the predetermined electric field is generated between the surface electrode and the counter electrode under a state in which droplets of a solution to be atomized, each having a diameter of from 0.001 mm to 1 mm, are supplied near the front surface of the surface electrode, to thereby generate, from the droplets, fine particles of the solution, which are smaller than the droplets;

a fluid conduit configured to convey the solution onto the front surface of the surface electrode; and a blower configured to blow a gas onto the front surface of the surface electrode, wherein the solution conveyed onto the front surface of the surface electrode advances in a thin film form in a blowing direction of the gas and is coated onto the front surface of the surface electrode.

18. An electrostatic atomizing device according to claim 17, wherein the fluid conduit comprises at least one of a plurality of holes defined by the surface electrode or a diffuser.

19. An electrostatic atomizing device according to claim 1, wherein the surface electrode is made of a metal.

20. An electrostatic atomizing device according to claim 1, further comprising one of a layer formed of a hydrophobic material and a layer formed of a hydrophilic material, which is formed on the front surface of the surface electrode.

21. An electrostatic atomizing device according to claim 1, wherein the counter electrode has a two-dimensionally expanded front surface.

22. An electrostatic atomizing device according to claim 21, wherein the two-dimensionally expanded front surface of the counter electrode faces the front surface of the surface electrode at least within a range in which the fine particles of the solution are to be generated.

23. An electrostatic atomizing device according to claim 21, wherein the front surface of the counter electrode is parallel to the front surface of the surface electrode.

24. A method of generating mist using an electrostatic atomizing device comprising:

a surface electrode having a two-dimensionally expanded front surface;

a counter electrode for generating a predetermined electric field between the counter electrode and the surface electrode;

a fluid conduit configured to convey the solution onto the front surface of the surface electrode; and a blower configured to blow a gas onto the front surface of the surface electrode, the method comprising:

generating the predetermined electric field between the surface electrode and the counter electrode under a state in which the front surface of the surface electrode is coated with a solution to be atomized in a thin film form, to thereby generate fine particles of the solution from a plurality of points of a surface of the solution, which is coated onto the surface electrode, wherein the solution conveyed onto the front surface of the surface electrode advances in the thin film form in a blowing direction of the gas and is coated onto the front surface of the surface electrode.

25. A method of generating mist using an electrostatic atomizing device comprising:

a surface electrode having a two-dimensionally expanded front surface, the surface electrode being formed into a plate-like shape;

a counter electrode for generating a predetermined electric field between the counter electrode and the surface electrode;

a fluid conduit configured to convey the solution onto the front surface of the surface electrode; and a blower configured to blow a gas onto the front surface of the surface electrode, the method comprising:

generating the predetermined electric field between the surface electrode and the counter electrode under a state in which droplets of a solution to be atomized, each having a diameter of from 0.001 mm to 1 mm, are supplied near the front surface of the surface electrode, to thereby generate, from the droplets, fine particles of the solution, which are smaller than the droplets, wherein the solution conveyed onto the front surface of the surface electrode advances in a thin film form in a blowing direction of the gas and is coated onto the front surface of the surface electrode.

26. A method of generating mist according to claim 24, wherein the solution has a viscosity of from 0.01 cP to 100 cP.

* * * * *